US011187425B2

(12) United States Patent
Mowris et al.

(10) Patent No.: US 11,187,425 B2
(45) Date of Patent: Nov. 30, 2021

(54) THERMOSTAT VARIABLE FAN-OFF DELAY

(71) Applicants: Robert J. Mowris, Olympic Valley, CA (US); John Walsh, Bozeman, MT (US)

(72) Inventors: Robert J. Mowris, Olympic Valley, CA (US); John Walsh, Bozeman, MT (US)

( * ) Notice: Subject to any disclaimer, the term of this patent is extended or adjusted under 35 U.S.C. 154(b) by 0 days.

(21) Appl. No.: 16/565,464

(22) Filed: Sep. 9, 2019

(65) Prior Publication Data

US 2021/0071888 A1 Mar. 11, 2021
US 2021/0199324 A9 Jul. 1, 2021

Related U.S. Application Data

(63) Continuation-in-part of application No. 16/289,313, filed on Feb. 28, 2019, now Pat. No. 10,712,036,
(Continued)

(51) Int. Cl.
*F24F 11/38* (2018.01)
*F24F 11/56* (2018.01)
(Continued)

(52) U.S. Cl.
CPC ..... *F24F 11/38* (2018.01); *F24F 11/56* (2018.01); *F24F 11/61* (2018.01); *F24F 11/67* (2018.01);
(Continued)

(58) Field of Classification Search
CPC ..... F24F 1/38; F24F 1/56; F24F 1/61; F24F 1/67; F24F 1/755; F24F 2140/40; F24F 1/60
See application file for complete search history.

(56) References Cited

U.S. PATENT DOCUMENTS 2,394,920 A 2/1946 Kronmiller
3,415,309 A 12/1968 Fieldler
(Continued)

OTHER PUBLICATIONS

Carrier Corporation. "EconoMi$er X, Factory—Installed Option, Low Leak Economizer for 2 Speed SAV (Staged Air Volume) Systems, Installation, Setup & Troubleshooting Supplement," Date: Feb. 2012, pp. 12, Published by Carrier Corporation, 7310 W. Morris St. D, Indianapolis, IN 46231, USA, https://dms.hvacpartners.com/docs/1009/Public/01/LLECON-01SI.pdf.
(Continued)

*Primary Examiner* — Marc E Norman
(74) *Attorney, Agent, or Firm* — Averill & Green; Kenneth L. Green

(57) ABSTRACT

A method for providing a variable fan-off delay after a thermostat call for cooling or after a heating on cycle for a Heating, Ventilation, Air Conditioning (HVAC) system. The variable fan-off delay may be ended based on comparing a measurement of a Conditioned Space Temperature (CST) to a CST threshold. The CST threshold may be based on a previous measurement of the CST monitored during the current variable fan-off delay. The CST threshold may be an inflection point where the rate of change of the CST with respect to time equals zero plus or minus a confidence interval tolerance. The CST threshold may also be a fan-off delay differential offset or a thermostat setpoint differential where the variable fan-off delay is ended when the measurement of the CST during the variable fan-off delay crosses the differential at least once after the cooling or heating on cycle.

15 Claims, 12 Drawing Sheets

Related U.S. Application Data which is a continuation-in-part of application No. 15/614,600, filed on Jun. 5, 2017, now Pat. No. 10,281,938, which is a continuation-in-part of application No. 15/358,131, filed on Nov. 22, 2016, now Pat. No. 9,671,125, which is a continuation-in-part of application No. 15/251,978, filed on Aug. 30, 2016, now Pat. No. 9,500,386, which is a continuation-in-part of application No. 15/144,806, filed on May 2, 2016, now Pat. No. 9,995,493, application No. 16/565,464, which is a continuation-in-part of application No. 16/011,120, filed on Jun. 18, 2018, now Pat. No. 10,663,186, which is a continuation-in-part of application No. 15/169,586, filed on May 31, 2016, now Pat. No. 10,001,289, application No. 16/565,464, which is a continuation-in-part of application No. 16/005,666, filed on Jun. 11, 2018, now Pat. No. 10,533,768.

(60) Provisional application No. 62/728,518, filed on Sep. 7, 2018.

(51) Int. Cl.

| | |
|---|---|
| ***F24F 11/61*** | (2018.01) |
| ***F24F 11/755*** | (2018.01) |
| ***F24F 11/67*** | (2018.01) |
| *F24F 140/60* | (2018.01) |
| *F24F 140/40* | (2018.01) |

(52) U.S. Cl.

CPC ..... *F24F 11/755* (2018.01); *F24F 2140/40* (2018.01); *F24F 2140/60* (2018.01)

(56) References Cited

U.S. PATENT DOCUMENTS

| | | | | |
|---|---|---|---|---|
| 4,136,730 | A | 1/1979 | Kinsey | |
| 4,136,822 | A | 1/1979 | Felter | |
| 4,369,916 | A | 1/1983 | Abbey | |
| 4,388,692 | A | 6/1983 | Jones | |
| 4,773,587 | A | 9/1988 | Lipman | |
| 4,842,044 | A | 6/1989 | Flanders | |
| 5,142,880 | A | 9/1992 | Bellis | |
| 5,239,834 | A | 8/1993 | Travers | |
| 5,248,083 | A | 9/1993 | Adams | |
| 5,582,233 | A | 12/1996 | Noto | |
| 6,220,039 | B1 | 4/2001 | Kensok | |
| 6,223,544 | B1 | 5/2001 | Seem | |
| 6,415,617 | B1 | 7/2002 | Seem | |
| 6,464,000 | B1 | 10/2002 | Kloster | |
| 6,684,944 | B1 | 2/2004 | Byrnes | |
| 6,695,046 | B1 | 2/2004 | Byrnes | |
| 6,708,135 | B2 | 3/2004 | Southworth | |
| 7,140,551 | B2 | 11/2006 | De Pauw | |
| 7,240,851 | B2 | 7/2007 | Walsh | |
| 7,444,251 | B2 | 10/2008 | Nikovski | |
| 7,500,368 | B2 | 3/2009 | Mowris | |
| 8,091,375 | B2 | 1/2012 | Crawford | |
| 8,543,244 | B2 | 9/2013 | Keeling | |
| 8,972,064 | B2 | 3/2015 | Grabinger | |
| 9,279,594 | B2 | 3/2016 | Steinberg | |
| 9,410,713 | B2 | 8/2016 | Lau | |
| 9,459,018 | B2 | 10/2016 | Fadell | |
| 9,519,295 | B2 | 12/2016 | Burton | |
| 9,534,805 | B2 | 1/2017 | Matsuoka | |
| 10,047,969 | B2 | 8/2018 | Lau | |
| 10,066,849 | B2 | 9/2018 | Lau | |
| 10,119,719 | B2 | 11/2018 | Lau | |
| 10,174,966 | B2 | 1/2019 | Lau | |
| 10,274,217 | B2 | 4/2019 | Gevelber | |
| 10,281,938 | B2 * | 5/2019 | Mowris | F24H 9/2064 |
| 10,712,036 | B2 * | 7/2020 | Mowris | F24F 11/76 |
| 2004/0154321 | A1 * | 8/2004 | Strand | F24F 11/30 62/176.6 |
| 2004/0217182 | A1 | 11/2004 | St. Jean | |
| 2005/0150651 | A1 * | 7/2005 | Halsey | F24F 11/70 165/267 |
| 2007/0057075 | A1 | 3/2007 | Votaw | |
| 2008/0083834 | A1 | 4/2008 | Krebs | |
| 2009/0001179 | A1 | 1/2009 | Dempsey | |
| 2015/0060557 | A1 | 3/2015 | Lau | |
| 2015/0309120 | A1 | 10/2015 | Bujak | |
| 2018/0038611 | A1 | 2/2018 | Lau | |
| 2018/0087795 | A1 | 3/2018 | Okita | |
| 2018/0313567 | A1 | 11/2018 | Steinberg | |
| 2019/0086106 | A1 | 3/2019 | Okita | |

OTHER PUBLICATIONS

Carrier Corporation, "48ES-A Comfort 13 SEER Single-Packaged Air Conditioner and Gas Furnace System with Puron® ®-410A) Refrigerant Single and Three Phase 2-5 Nominal Tons KSizes 24-60), 48ES-A Installation Instructions," Date: Sep. 2010, pp. 36. Published by Carrier Corporation, 7310 W. Morris St. D, Indianapolis, IN 46231, USA. Available online at: http://dms.hvacpartners.com/docs/1009/Public/0E/48ES-05SI.pdf.

Lux Products Corporation, "Power Bridge Installation" provides 24V AC power to thermostats in homes without C-wires, allows homes with 3 and 4 wire systems to use smart thermostats without requiring a new wire to be installed between furnace and thermostat. Date Jun. 2017. pp. 2. Published by LUX Products Corporation, 4747 S Broad St #330, Philadelphia, PA 19112 USA. See https://pro.luxproducts.com/powerbridge/.

Honeywell International Inc., "Electro-Mechanical Wiresaver THP9045A1023/U Wiring Module" for Honeywell thermostats is a C-Wire Adapter for Wi-Fi thermostats or RedLINK 8000 series Honeywell thermostat models. Date: Dec. 2010. pp. 12. Published by Honeywell Limited, 35, Dynamic Drive, Toronto, Ontario M1V 4Z9 Canada. See https://customer.honeywell.com/en-US/Pages/Product.aspx?cat=HonECC+Catalog&pid=thp9045a1023/U.

Florida Solar Energy Center (FSEC) authored by Henderson, H., Shirey, D., Raustad, R., "Understanding The Dehumidification Performance of Air-Conditioner Equipment at Part-Load Conditions," Final Report FSEC-CR-1537-05, Date: Jan. 2006. pp. 613, Published by FSEC, 1679 Clearlake Rd, Cocoa, FL 32922 USA. See http://www.fsec.ucf.edu/en/publications/pdf/FSEC-CR-1537-05.pdf.

Ecobee Inc. "EBPEK01 Smart SI Power Extender Kit" provides common wire for 5-wire thermostats if only 4 wires are available at existing thermostat. Date: Apr. 2013. pp. 2. Published by Ecobee Inc., Toronto, Canada. See https://support.ecobee.com/hc/en-us/articles/360009155051-Installing-your-ecobee-thermostat-with-the-Power-Extender-Kit-no-C-wire-.

Venstar Inc. "Add-a-Wire™" In applications where additional wiring cannot be installed, the Add-A-Wire accessory can be used to add a wire to the thermostat. Date: Feb. 2012. pp. 4. Published by Venstar Inc., 9250 Owensmouth Ave, Chatsworth, CA 91311 USA. See https://venstar.com/thermostats/accessories/add-a-wire/.

Honeywell International Inc., "Jade™ Economizer Module (Model W7220)" Date: Mar. 2014. pp. 32. Published by Honeywell Home and Building Technologies, 715 Peachtree Street NE, Atlanta, GA 30308 USA. See https://customer.honeywell.com/resources/techlit/TechLitDocuments/63-0000s/63-2700.pdf.

Littelfuse Inc., KSPS Series Programmable Timer, Date: 2016. pp. 3, Littelfuse, Inc., 222 Disk Drive, Rapid City, SD 57701 USA, 800-843-9948, USA (Littlefuse 2016). See http://www.littelfuse.com/~/media/protection-relays/datasheets/timedelay-relays/littelfuse_timedelayrelays_ksps_datasheet.pdf.

ICM Controls Inc., ICM 254 Post Purge Timers, Date: Oct. 2, 2007. pp. 1, ICM Controls, Inc., 6333 Daedalus Dr., Cicero, N.Y. 13039, USA (ICM 254). See http://s3.supplyhouse.com/manuals/1266443921310/26370_PROD_FILE.pdf.

(56) References Cited

OTHER PUBLICATIONS

Southern California Edison, Proctor Engineering Group, Ltd., Bevilacqua-Knight, Inc., Energy Performance of Hot Dry Air Conditioning Systems, Date: Jul. 2008. pp. 128, California Energy Commission (CEC), Sacramento, CA, USA.
Proctor Engineering Group, Ltd., Hot Dry Climate Air Conditioner Pilot Field Test, Emerging Technologies Application Assessment Report #0603, Date: Mar. 2, 2007, pp. 41, Pacific Gas & Electric Company (PG&E), San Francisco, CA, USA.
Proctor Engineering Group, Ltd., Hot Dry Climate Air Conditioner Pilot Field Test Phase II, Emerging Technologies Program Application Assessment Report #0724, Date: Feb. 8, 2008, pp. 39, Pacific Gas & Electric Company (PG&E), San Francisco, CA, USA.
Conant A., Proctor, A., Elberling, L., Field Tests of Specially Selected Air Conditioners for Hot Dry Climates, Published in the Proceedings of the 2008 ACEEE Summer Study on Energy Efficiency in Buildings, Asilomar, California, Date: Aug. 2008, pp. 14, American Council for an Energy Efficient Economy (ACEEE), Washington, DC, USA.
Proctor Engineering Group Ltd., Concept 3™ Furnace Fan Motor Upgrade, Date: Oct. 1, 2009, pp. 14, Published by Proctor Engineering Group Ltd., 65 Mitchell Blvd Ste 201, San Rafael, CA 94903, USA.
Khattar, M., Swami, M., Ramanan, N., Another Aspect of Duty Cycling: Effects on Indoor Humidity. ASHRAE Transactions vol. 93, Part 1, Jan. 1987, pp. 1678-1687. American Society of Heating Refrigerating and Air-Conditioning Engineers (ASHRAE), Atlanta, GA, USA (Khattar 1987). Available at http://www.fsec.ucf.edu/en/publications/html/FSEC-PF-118-87/index.htm.
Proctor Engineering Group Ltd., Hot Dry Climate Air Conditioner (HDAC) Combined Field Test Report, Date: Jul. 19, 2007, pp. 26. Proctor Engineering Group Ltd., 65 Mitchell Blvd Ste 201, San Rafael, CA 94903, USA (Proctor 2007). See: https://newbuildings.org/wp-content/uploads/2015/11/1140FieldTestRpt2_01.pdf.
Motors and Armatures (MARS) Inc., Series 325 MARS Solid State Timers, MARS No. 32393 and 32378, Date: Sep. 4, 2007, pp. 1, Published by Motors & Armatures, Inc. (MARS), 250 Rabro Drive East, Hauppauge, NY 11788, USA.
California Utilities Statewide Codes and Standards Team, Codes and Standards Enhancement (CASE) Initiative: Residential Refrigerant Charge Testing and Related Issues, 2013 California Building Energy Efficiency Standards, Date: Dec. 2011, pp. 51-61, authored by Pacific Gas and Electric (PG&E) Company, San Francisco, CA, USA.
Proctor, J., Hairrell, A., "An Innovative Product's Path to Market. The influence of laboratory and field evaluations on adoption and implementation," Date: Aug. 2013, pp. 7-8, Published by International Energy Program Evaluation Conference (IEPEC), Chicago, IL, USA (Proctor 2013). Available online at https://www.iepec.org/conf-docs/conf-by-year/2013-Chicago/050.pdf#page=1.
Proctor Engineering Group, LTD.,"CheckMe!® Concept 3—Brush Free DC by McMillan Installation Instructions," Dated: Dec. 31, 2008, pp. 7, Prepared by Proctor Engineering Group Ltd., 418 Mission Ave., San Rafael, CA 94901 USA.
Energy Federation Inc. (EFI), "Promo—Concept 3 High Efficiency Motor," Date: Jan. 29, 2009, pp. 3, Prepared by Energy Federation Inc. (EFI), 40 Washington St, Westborough, MA 01581 USA.
Proctor Engineering Group, Ltd.,"Promo—Concept 3 PEG Calif-Photo," Date: Nov. 4, 2008, p. 1, Proctor Engineering Group Ltd., 418 Mission Ave., San Rafael, CA 94901 USA.
Proctor Engineering Group, Ltd., "Enhanced Time Delay Relay Installation Procedure," Date: Nov. 28, 2006, pp. 4, Prepared by Proctor Engineering Group Ltd., 418 Mission Ave., San Rafael, CA 94901 USA.
Proctor Engineering Group, Ltd., "Air Conditioner Enhanced Time Delay Relay" (DelayRelayFactSheet 3-LR.pdf), Date: Dec. 31, 2007, pp. 2, Proctor Engineering Group Ltd., 418 Mission Ave., San Rafael, CA 94901 USA.
Pacific Gas & Electric (PG&E) and authored by Abram Conant of Proctor Engineering Group, Ltd., titled "California Climate Air Conditioner Upgrade—Enhanced Time Delay Measure Codes H796 Cooling Optimizer Program, Work Paper PGE3PHVC150 Enhanced Time Delay Relay Revision # 1," Date: May 5, 2014, pp. 36, published by PG&E Customer Energy Solutions, San Francisco, CA, USA.
Carrier. 1995. HVAC Servicing Procedures (Proper Airflow Method). SK29-01A, 020-040, Date: 1995, pp. 8, Published by Carrier Corporation, 7310 W. Morris St. D, Indianapolis, IN 46231, USA.
California Energy Commission (CEC). 2008 Residential Appendices for the Building Energy Efficiency Standards for Residential and Nonresidential Buildings. CEC-400-2008-004-CMF, Date: Dec. 1, 2008. pp. 22, Published by the California Energy Commission, 516 9th Street, Sacramento, CA 95814, USA.
Yuill, David p. and Braun, James E., 2012. "Evaluating Fault Detection and Diagnostics Protocols Applied to Air-Cooled Vapor Compression Air-Conditioners." International Refrigeration and Air Conditioning Conference. Paper 1307. Date: Jul. 12, 2016, pp. 11, Published by Ray W. Herrick Laboratories, 177 S. Russell Street, West Lafayette, IN 47907-2099, http://docs.lib.purdue.edu/iracc/1307.
California Energy Commission. Reference Appendices The Building Energy Efficiency Standards for Residential and Nonresidential Buildings. CEC-400-2012-005-CMF-REV3, Date: May 15, 2012, pp. 36, Published by the California Energy Commission, 516 9th Street, Sacramento, CA 95814, USA.
R. Mowris, E. Jones, R. Eshom, K. Carlson, J. Hill, P. Jacobs, J. Stoops. Laboratory Test Results of Commercial Packaged HVAC Maintenance Faults. Date: Feb. 25, 2016, pp. 18, Published by the California Public Utilities Commission, 505 Van Ness Ave, San Francisco, CA 94102. USA.
Pacific Northwest National Laboratory, Building Re-Tuning Training Guide: AHU Minimum Outdoor-Air Operation (PNNL 2014, PNNL-SA-88958), Date: Aug. 21, 2012, pp. 9, Published by the Pacific Northwest National Laboratory, 902 Battelle Blvd, Richland, WA 99354, USA. https://buildingretuning.pnnl.gov/documents/pnnl_sa_88958.pdf.
S. Katipamula, R. Lutesm, H. Ngo, R. Underhill, Transactional Network Platform: Applications (PNNL-22941), Date: Oct. 31, 2014, pp. 72, Published by the Pacific Northwest National Laboratory, 902 Battelle Blvd, Richland, WA 99354, USA. https://transactionalnetwork.pnnl.gov/documents/PNNL-22941.pdf.
M. Rezagholizadeh, K. Salahshoor and E. M. Shahrivar, "A fault detection and diagnosis system based on input and output residual generation scheme for a Continuous Stirred Tank Reactor (CSTR) benchmark process," Date: Jul. 17, 2010, pp. 6. IEEE International Conference on Mechatronics and Automation, Xi'an, China, pp. 1898-1903. doi: 10.1109/ICMA.2010.5588956. Published by IEEE 445 Hoes Lane Piscataway, NJ 08854-4141, USA. http://ieeexplore.ieee.org/stamp/stamp.jsp?tp=&arnumber=5588956&isnumber=5587913.

* cited by examiner

THERMOSTAT VARIABLE FAN-OFF DELAY

CROSS-REFERENCE TO RELATED APPLICATIONS

The present application claims the priority of U.S. Provisional Patent Application Ser. No. 62/728,518 filed Sep. 7, 2018, and is a Continuation In Part of U.S. patent application Ser. No. 16/005,666 filed Jun. 11, 2018, and the present application is a Continuation In Part of U.S. patent application Ser. No. 16/289,313 filed Feb. 28, 2019, which is a Continuation In Part of U.S. patent application Ser. No. 15/614,600 filed Jun. 5, 2017, which is a Continuation In Part of U.S. patent application Ser. No. 15/358,131 filed Nov. 21, 2017, which is a Continuation In Part of U.S. patent application Ser. No. 15/251,978 filed Aug. 30, 2016, which is a Continuation In Part of U.S. patent application Ser. No. 15/144,806 filed May 2, 2016, which applications are incorporated in their entirety herein by reference. The present application is also a Continuation In Part of U.S. patent application Ser. No. 16/011,120 filed Jun. 6, 2018, which is a Continuation In Part of U.S. patent application Ser. No. 16/005,666 filed Jun. 11, 2018, and is also a Continuation In Part of U.S. patent application Ser. No. 15/169,586 filed May 31, 2016.

BACKGROUND OF THE INVENTION

Field of the Invention

The present invention relates to a Heating, Ventilation, Air Conditioning (HVAC) fan controller, a furnace control board, a Forced Air Unit (FAU) control board, a thermostat, a software application, or a fan motor.

Background

Residential and commercial HVAC system power consumption in the United States accounts for 30% of average summer peak-day electricity loads, 32% of total electricity use, and 44% of total natural gas use, as reported by the US Energy Information Agency Residential and Commercial Energy Consumption Surveys from 2012 and 2015.

Known gas furnace central heating systems are controlled by thermostats which energize a relay to turn on the gas furnace heat source with a brief delay followed by turning on the heater ventilation fan at a lower fan speed than the higher fan speed used for cooling. Maintaining a lower heater ventilation fan speed often results in increased heat soak within the central heating unit and the portion of the heat generated by the heat source not delivered to conditioned space is lost to the environment. The heat loss increases the central heating unit operational time consuming more energy.

Further, the amount of heat soak increases as the central heating unit is operated for longer periods of time leaving significantly more unrecovered energy and higher temperatures (i.e., 260 to 350 degrees Fahrenheit) in the heat exchanger after the heater ventilation fan is turned off. In most heating systems a significant portion of this unrecovered heating energy is wasted and lost to the environment after the heat source and the heater ventilation fan are tuned off.

Known direct-expansion cooling systems are controlled by thermostats which turn on a cooling ventilation fan when the cooling source is energized and turn off the fan when the cooling source is de-energized. When the cooling source is de-energized there is a significant amount of cold water condensed onto the evaporator coil which is not used to deliver sensible cooling capacity to the conditioned space and this sensible cooling capacity is lost to the environment after the cooling source and the cooling ventilation fan are tuned off. This increases the cooling system operational time and energy use.

Known heat pump, electric resistance, and hydronic heating systems are controlled by thermostats which turn on the ventilation fan when the hydronic heat source is energized and turn off the fan when the heat source is de-energized. Hydronic heating and cooling systems circulate a liquid from a central location to a heat exchanger in a Forced Air Unit (FAU). Known heat pump and hydronic systems provide either a very short fixed fan-on delay or no fan-on delay and a short fixed fan-off delay or no fan-off delay due to lower heat exchanger temperatures of 130 to 180 degrees Fahrenheit which are 2 to 3 times lower than gas furnace heat exchanger temperatures. During the start-up period there is no useful heating delivered by the ventilation air which can waste fan energy and cause thermal comfort issues for building occupants. When the heat source is de-energized there is a significant amount of heating energy left in the heating coil which is not used to deliver heating capacity to the conditioned space and this heating capacity is lost to the environment after the heat source and the heating ventilation fan are tuned off. This increases the heat pump, electric resistance, or hydronic heating system operational time and energy use.

Buildings are cooled and/or heated to maintain proper thermal comfort conditions for occupants. Low airflow and low cooling capacity will reduce thermal comfort and equipment efficiency and increase AC equipment operation and energy use. Buildings are also required to provide a minimum flow of outdoor air into their HVAC systems per the American Society of Heating Refrigeration and Air-Conditioning Engineers (ASHRAE) Standard 61.1 (ANSI/ASHRAE 62.1-2010. Standard Ventilation for Acceptable Indoor Air Quality) and the California Energy Commission (CEC) Building Energy Efficiency Standards for Residential and Nonresidential Buildings (CEC-400-2012-004-CMF-REV2). When the outdoor airflow exceeds the minimum required airflow, the additional airflow may introduce unnecessary hot outdoor air when the HVAC system is cooling the building, or introduce unnecessary cold outdoor air when the HVAC system is heating the building. The combination of low airflow, low cooling capacity, excess outdoor airflow and high outdoor ambient temperatures can cause significant thermal comfort and health issues. Unnecessary or unintended outdoor airflow reduces space cooling and heating capacity and efficiency and increases cooling and heating energy consumption and the energy costs required to provide space cooling and heating to building occupants. Known methods for measuring the amount of outdoor airflow introduced into buildings to meet minimum requirements are inaccurate and better methods are required to improve thermal comfort of occupants, reduce cooling and heating energy usage, and improve cooling and heating energy efficiency.

U.S. Pat. No. 6,684,944 (Byrnes '944) and U.S. Pat. No. 6,695,046 (Byrnes '046) disclose a variable speed fan motor control for forced air heating/cooling systems using an induction-type fan motor controlled by a controller circuit which is operable to continuously vary the speed of the fan motor during a start-up phase and a shut-down phase of the heating and/or cooling cycle. The controller circuit includes temperature sensors which are operable to control start-up and shutdown of the fan motor over continuously variable speed operating cycles in response to sensed temperature of the air being circulated by the fan. Byrnes teaches control of the heater fan from low to high speed but the high speed is limited specifically to the motor speed used for heating which is low, medium, or medium high and not the motor's high speed used for cooling.

U.S. Pat. No. 4,369,916 (Abbey '916) discloses a 120 Volts Alternating Current (VAC) heating or cooling system fan override relay control to immediately start the blower or the HVAC fan to circulate air when the heating or cooling element turns on and continue to operate the override for a fixed timed interval by a time delay relay after the heating or cooling element turns off. The '916 teaches starting the blower or the HVAC fan instantly when the heating element is turned on.

U.S. Pat. No. 6,464,000 (Kloster '000) discloses is a temperature controlled device for a two-stage furnace: 1) low fan speed for low heat mode, and 2) higher fan speed for high heat mode. The higher fan speed is limited to available heater fan speeds; not the high speed used for cooling.

U.S. Pat. No. 5,248,083 (Adams '083) discloses an adaptive furnace controller using analog temperature sensing to maintain a constant preselected heat exchanger temperature (i.e., 120 Fahrenheit) during operation and operates the fan time delay until a fixed lower heat exchanger temperature (i.e. 90 Fahrenheit) is reached. The adaptive furnace control regulates a controllable valve to adjust burner firing rate, thereby holding heat exchanger operating temperature constant to create constant on/off times based on the previous cycle on/off times of the furnace by regulating circulation blower speed. By increasing blower speeds to shorten "on" times or decreasing blower speeds to increase "on" times, and thereby achieving optimum cycle times.

ICM Controls, Inc. (www.icmcontrols.com) has manufactured on delay/off delay controls for HVAC circulating fans for more than 25 years. The ICM fan delays connect between the fan "G" terminal of a thermostat to an HVAC fan relay used to energize the HVAC fan, but the on delay/off delay are fixed time delays and only have one input and one output to interrupt and control the fan.

U.S. Pat. No. 5,142,880 (Bellis '880) discloses a solid state control circuit for use in connection with existing low-voltage thermostat terminals of a split-system or packaged HVAC system having a refrigerant system compressor and condenser with outdoor fan and an evaporator and gas-fired furnace or electrical heating elements with indoor blower fan. The '880 patent relates generally to systems for increasing the efficiency of air conditioning units by continuing the blower run time after the compressor is turned off. Specifically, the '880 patent claims an air conditioning control unit comprising a low voltage room thermostat fan terminal, a low voltage compressor relay terminal, a timing circuit means, a sensitive gate triac, and a power triac. The '880 patent also claims a method for controlling the on-off time of an indoor fan that is controlled by and associated with an indoor thermostat for a room air conditioning system. The apparatus of the '880 patent is not programmable or adaptable. It does not have a fixed delay from one system to another. The delay is related to the supply voltage, which varies from system to system. Bellis provides constant current to the triac gates on the order of 6 milliamps. The total current draw is even higher than that when all components are included. Many systems have do not accommodate this much current draw through control relays without causing a humming noise which irritates the user. The Bellis design momentarily de-energizes the relay when switch from thermostat driven fan to his delay. This can cause relay chatter and excessive wear. Bellis does not provide for an override function if the unit fails. The Bellis design is a "fixed" delay.

U.S. Pat. No. 5,582,233 (Noto '233) teaches of a device used to extend the fan run time and also periodically activate the fan during times the system is not calling for heating or cooling. Noto requires the circuit to have access to the 24 VAC signals from the AC transformer. This requirement precludes his device from being connected directly to the thermostat since most thermostats do not have both the hot and neutral legs of the transformer. Household wiring only provides the hot (red) signal to the transformer. Although Noto teaches of a range of delays, his invention uses fixed times for the delays.

U.S. Pat. No. 4,842,044 (Flanders '044) provides a heating and cooling control system that works by energizing a fan or other fluid circulating device to circulate fluid and effect thermal transfer of energy from the fluid to the spaces being heated and by de-energizing the circulating means at a selected time interval after de-energization of the heating and control system. The '044 patent also claims a heating control system comprising a switching means to effect energization of the fluid circulating means, a switching control means that is energizable in response to operation of the control circuit, and an additional circuit means that energizes the switching control means a selected time interval after de-energization of the heating system. The '044 patent is intended to increase the time the fan is turned on after a heating cycle to improve energy efficiency. The device draws power continuously from the gas solenoid through a 680 ohm resistor, and this method has proven to be problematic in practice. Too much current drawn in this way, can cause a humming noise in the gas valve and false operation. The '044 patent also enables the fan relay to activate the blower as soon as the gas valve is activated. This results in cool air being circulated throughout the home since the plenum is not sufficiently warm. Normal heat operation retards the blower until the temperature in the plenum reaches a preset operating temperature. The '044 patent also requires the addition of a relay circuit. This relay must be active the entire time the fan is to be off, creating a significant current draw even when the system is in not calling for heating or cooling. The '044 patent also describes fixed delays. It has no way to adapt the fan delay times either by user input or by the compressor run time. The delays provided by the '044 patent are also subject to the variations of the components selected. Additionally, although Flanders touches on the subject of how his invention works when the fan switch on the thermostat is moved from the AUTO position to the ON position, as described, there is no way for the fan to come on when the occupant requests.

U.S. Pat. No. 4,136,730 (Kinsey '730) teaches of a device that intervenes with the controls coming from a thermostat and going to the heating/cooling system. The '730 patent discloses a fixed upper limit to the time that the compressor or heating source can be activated and then his invention adds additional time to the blower fan. This activity can increase the efficiency of an air conditioner system by allowing a certain amount of water to condense on the evaporator coil and then re-evaporating this water to cool the home. The amount of water collected will vary based on the humidity of the ambient air. Having a fixed compressor run time with a fixed blower time can create a less efficient system than the current invention. In many environments, limiting the compressor run time and counting on evaporative cooling to reduce the home's temperature will increase the time required to cool the home. In many cases, the desired set point may never be achieved.

U.S. Pat. No. 7,240,851 (Walsh '851) teaches about a furnace fan timer. The '851 device is a timer with a user programmable interval and duration. The device runs continuously in a never ending loop counting down minutes before operating the fan and then counting the minutes to keep the fan activated. The '851 device is not compatible with air conditioner systems. Most thermostats connect the fan switch to the air conditioner compressor switch when operating in the automatic fan mode. In systems with air conditioners, the '851 invention will activate the air conditioner compressor when it turns on the fan. This requires users to turn off the circuit breakers for their air conditioner systems when using his device. The '851 has two interchangeable wire connections.

U.S. Pat. No. 2,394,920, (Kronmiller '920) teaches of an HVAC thermostat device to control room temperatures using a pair of thermally responsive bimetallic strips mounted within a circular-shaped housing to control space cooling or heating equipment using low voltage signals.

U.S. Pat. No. 7,140,551 (de Pauw '551) teaches of a similar HVAC thermostat device with a simplified user interface and circular-shaped housing to control space cooling or heating equipment using low voltage signals.

The World Intellectual Property Organization (WIPO) publication number WO 2014/047501 A1 (Fadell et al. '501) discloses apparatus, systems, methods, and related computer program products for providing smart home objectives. Fadell '501 discloses a plurality of devices, including intelligent, multi-sensing, network-connected devices, that communicate with each other and/or with a central server or a cloud-computing system to provide any of a variety of useful smart home objectives including controlling a thermostat.

U.S. Pat. No. 9,459,018 B2 (Fadell et al. '018) discloses systems and methods for efficiently controlling energy-consuming systems, such as heating, ventilation, or air conditioning (HVAC) systems. Fadell '018 discloses an electronic device (e.g., thermostat) to control an HVAC system to encourage a user to select energy-efficient temperature setpoints. Based on the selected temperature setpoints, the electronic device may generate or modify a schedule of temperature setpoints to control the HVAC system.

U.S. Pat. No. 9,534,805 (Matsouka '805) describes a system and method for controlling fan-only cooling where a first phase of a first cooling cycle may be initiated in an enclosure using an air conditioning system having a compressor and a fan that passes air over an evaporator coil. The first phase may include activation of the compressor and activation of the fan. A relative humidity may be measured within the enclosure during the first phase of the first cooling cycle. Subsequent to the first phase and in response to the relative humidity being determined to be below a threshold relative humidity, a second phase of the first cooling cycle may be initiated during which the fan is activated but the compressor is not activated (i.e., fan cooling). The Matsuoka '805 Column 19 lines 36:49 states: "In step 840 the backplate measures and logs the temperature, and fan cooling continues until: (1) the temperature reaches the LMBT; (2) the temperature rises above an upper limit (=fan cooling start temp+a small fixed value); (3) the fan cooling time limit 40 expires (=expected fan cooling time+a fixed value, temp2) or (4) the fan cooling reaches a maximum time limit (e.g. 10 minutes). In one example, it has been found that 0.1 F. is a suitable value for temp2 such that fan cooling stops if the current temperature either drops below LMBT, or if the current temperature increases more than 0.1 F. above the fan cooling starting temperature. When at least one of the four conditions is met then in step 844 the backplate wakes the head unit and fan cooling is ceased." Matsuoka '805 discloses four methods to turn off fan-cooling: 1) when thermostat temperature reaches the Lower Mean Band Temperature (LMBT), 2) when thermostat temperature increases above an upper limit (=fan cooling start temp plus a small fixed value), 3) when the fan-cooling time limit expires and 4) when fan cooling reaches a maximum time limit of 10 minutes. The Matsuoka WO 2013/149160 abstract further discloses: "The duration of the fan cooling period is adjusted based on temperature measurements made during the previous cooling cycle that ended with fan cooling." The Matsouka '805 "small fixed value" of 0.1 F doesn't vary and doesn't provide sufficient control for all cooling conditions. The '805 describes sensors incorporated in the thermostat to detect occupancy, temperature, light and other environmental conditions and influence the control and operation of HVAC system.

International Publication Number WO 2013/149160 (Matsuoka 2013) discloses controlling fan-only cooling duration following normal air conditioning operation. Following normal AC cooling, economical fan cooling is used. The duration of the fan cooling period is adjusted based on temperature measurements made during the previous cooling cycle that ended with fan cooling. An expected temperature drop to be provided by fan cooling as well as an expected time to achieve that drop is calculated based on prior measurements of the cooling operating time. The expected values are then used to improve fan cooling for subsequent cooling cycles. In some cases, fan cooling is not initiated unless: (1) a time limit has an elapsed, such that sufficient condensation is allowed to form on the evaporator coil during the first phase, and (2) indoor relative humidity is below a predetermined threshold. Matsuoka discloses de-energizing the compressor early, generally when the thermostat temperature decreases to the cooling setpoint, and continuing to energize the fan until a first thermostat Lower Maintenance Band Temperature (LMBT) is reached. Matsouka teaches that if the LMBT is not reached within 2.5 minutes of fan-only operation, then the fan is de-energized.

U.S. Pat. No. 4,388,692 (Jones et al, 1983) discloses an electronically controlled digital thermostat having variable threshold differential with time in discrete steps. In the heat mode when the triac (heat) is turned on, the differential may be 0.5° F., above the set temperature for a predetermined time period (6 minutes) and then decreased to the set temperature until the triac is turned off. When the triac is turned off, the differential is varied to be 0.5° F. less than the set temperature for 6 minutes and then is increased to the set temperature until the triac is turned back on. In the cooling cycle, the threshold differential characteristic is +/−0.5° F. for ten minutes versus the six minutes in heating mode. The Jones '692 patent controls the range of acceptable cycling of the heating and air conditioning systems and defines a maximum acceptable heating cycling rate of 6 to 7 cycles per hour (i.e., 4 to 5 minutes on and 4 to 5 minutes off per cycle) and a maximum cooling cycle rate for an air conditioner of 3 to 4 cycles per hour (i.e., 7.5 to 10 minutes on and 7.5 to 10 minutes off per hour).

Non-patent publication published by SOUTHERN CALIFORNIA EDISON and authored by PROCTOR ENGINEERING GROUP, LTD., BEVILACQUA-KNIGHT, INC., "Energy Performance of Hot Dry Air Conditioning Systems," Report Number CEC-500-2008-056, July 2008, Pages 15, 50, 65-66, California Energy Commission, Sacramento, Calif. USA (CEC '056). Available online at: http://www.energy.ca.gov/2008publications/CEC-500-2008-056/CEC-500-2008-056.PD F. Pages 65 and 66 of the CEC '056 non-patent publication provides laboratory test data performed by Southern California Edison (SCE) of a latent recovery method where the fan operates continuously and the compressor is paused or turned off intermittently which is referred to as a Compressor Pause Mode (CPM) on page 2 of the PG&E #0603 non-patent publication discussed below. CEC '056 describes the latent recovery method as "cooling energy . . . stored as moisture removal" which "will be lost down the condensate drain unless it is recovered at the end of the compressor cycle."

Non-patent publication published by PACIFIC GAS & ELECTRIC (PG&E) and authored by PROCTOR ENGINEERING GROUP, LTD., "Hot Dry Climate Air Conditioner Pilot Field Test," Emerging Technologies Application Assessment Report #0603. Date: Mar. 2, 2007, Pages 41, Pacific Gas & Electric (PG&E) Company, San Francisco, Calif., USA (PG&E #0603). Available online at: http://www.etcc-ca.com/reports/hot-dry-climate-air-conditioner-pilot-field-test. The PG&E #0603 non-patent publication discloses two latent recovery methods: 1) Compressor Pause Mode; and 2) optimal fixed fan-off delays for different climate zones with high, medium, or low speed fan during the fan-off delays. Variable speed fan motor operation during fan-off delays was disclosed by Byrnes in U.S. Pat. No. 6,684,944 issued on Feb. 3, 2004 and U.S. Pat. No. 6,695,046 issued Feb. 24, 2004.

Non-patent publication published by PACIFIC GAS & ELECTRIC (PG&E) and authored by PROCTOR ENGINEERING GROUP, LTD., "Hot Dry Climate Air Conditioner Pilot Field Test Phase II, Emerging Technologies Program Application Assessment Report #0724," Date: Feb. 8, 2008, Pages 39, PG&E Company, San Francisco, Calif., USA, (PG&E #0724). Available online at: https://newbuildings.org/sites/default/files/PGE_2008_Pilot_Field_Test_Report.pdf. The PG&E #0724 non-patent publication discloses optimal fixed fan-off delays for various AC operating times in different climate zones where the fan is operated at high, medium, or low speed fan operation during the fan delay using a variable speed Electronically Commutated Motor (ECM). Variable speed fan motor operation during fan-off delays was disclosed by Byrnes in U.S. Pat. No. 6,684,944 issued on Feb. 3, 2004 and U.S. Pat. No. 6,695,046 issued Feb. 24, 2004.

Non-patent publication published by American Council for an Energy Efficient Economy (ACEEE) and authored by ABRAM CONANT, JOHN PROCTOR, LANCE ELBERLING, "Field Tests of Specially Selected Air Conditioners for Hot Dry Climates," Published in the Proceedings of the 2008 ACEEE Summer Study on Energy Efficiency in Buildings, Asilomar, Calif., Date: August 2008, Pages 14, American Council for an Energy Efficient Economy, 529 14th Street NW, Suite 600, Washington, D.C. 20045 USA (Conant 2008). Available online at: http://aceee.org/files/proceedings/2008/data/papers/1_537.pdf. The Conant 2008 non-patent publication discloses potential energy efficiency improvements from fixed fan-off time delays for various air conditioning operating times using a variable-speed brushless DC fan motor to operate the fan at a lower speed during the fan-off delay. Variable speed fan motor operation during fan-off delays was disclosed by Byrnes in U.S. Pat. No. 6,684,944 issued on Feb. 3, 2004 and U.S. Pat. No. 6,695,046 issued Feb. 24, 2004.

Non-patent unpublished report authored by PROCTOR ENGINEERING GROUP, LTD., "Concept 3™ Furnace Fan Motor Upgrade," Prepared by Proctor Engineering Group. Date: Oct. 1, 2009. Pages 14. Published by Proctor Engineering Group Ltd., 65 Mitchell Blvd Ste 201, San Rafael, Calif. 94903. (Proctor 2009). The Proctor 2009 unpublished report discloses a method of controlling a variable speed fan motor to provide a cooling fan-off delay. Variable speed fan motor operation during fan-off delays was disclosed by Byrnes in U.S. Pat. No. 6,684,944 issued on Feb. 3, 2004 and U.S. Pat. No. 6,695,046 issued Feb. 24, 2004.

Non-patent publication published by MOTORS AND ARMATURES (MARS) Inc., SERIES 325 MARS Solid State Timers, MARS number 32393 and 32378, Date: Sep. 4, 2007, Pages 1, Published by Motors & Armatures, Inc. (MARS), 250 Rabro Drive East, Hauppauge, N.Y. 11788, USA (Mars 2007). MARS describes two fan-off delay relay controls: 1) MARS 32393 and 2) MARS 32377. Available online: www.marsdelivers.com. MARS 32393 provides a fixed 2-minute fan-off delay and is installed between the fan "G" terminal of a thermostat and the HVAC fan relay used to energize the HVAC fan. MARS 32393 and 32377 connect to both sides of the system transformer, hot and neutral, and use a single input and a single output. MARS 32377 provides a knob on the front of the device for the user to select a fixed fan-off delay time from 0 to 360 seconds.

Non-patent unpublished report authored by PROCTOR ENGINEERING GROUP, LTD., "California Air Conditioner Upgrade—Enhanced Time Delay Relay—Residential, Work Paper WPPEGPGE0001," Date: May 18, 2008, Pages 15, Provided to me on Oct. 12, 2017 by Proctor Engineering Group Ltd., 65 Mitchell Blvd. Suite 201, San Rafael, Calif. 94903, USA (Proctor 2008). The Proctor 2008 non-patent unpublished report was not disseminated or made available to the extent that persons interested and ordinarily skilled in the subject matter or art, exercising reasonable diligence, could locate the reference. Proctor 2008 describes a cooling fan-off delay Enhanced Time Delay (ETD) product providing a fan-off delay with a variable speed Electronically Commutated Motor (ECM or a fixed speed Permanent Split Capacitance (PSC) motor. Data provided in the Proctor 2008 workpaper are for continuous high speed fan operation and intermittent compressor operation (i.e., variable compressor "on" and "off" times) per the Compressor Pause Mode (CPM) method disclosed on page 21 of the PG&E #0603 and Figure 48 (p. 66) of CEC '056. Variable fan speed operation during fan-off delays was disclosed by Byrnes in U.S. Pat. No. 6,684,944 issued on Feb. 3, 2004 and U.S. Pat. No. 6,695,046 issued Feb. 24, 2004.

Non-patent unpublished report authored by PROCTOR ENGINEERING GROUP, LTD., "Workpaper Extended Fan Time Delay Relay," Date: Feb. 9, 2007, Pages 7, Prepared by Proctor Engineering Group Ltd., 418 Mission Ave., San Rafael, Calif. 94901 USA (Proctor 2007). Proctor 2007 was not disseminated or made available to the extent that persons interested and ordinarily skilled in the subject matter or art, exercising reasonable diligence, could locate the reference. Data provided in the Proctor 2007 workpaper are for continuous high speed fan operation and intermittent compressor operation per the CPM method disclosed on page 21 of the PG&E #0603 and Figure 48 (p. 66) of CEC '056. Proctor 2007 suggests that a fixed time delay is optimal (i.e., "5-minute time delay is closer to optimum" and "energy savings for ECM units with low speed are double the PSC savings"). No information is provided in Proctor 2007 to define any relationship between the fan-off delay "tail" and the AC compressor cycle length. Variable fan speed operation during fan-off delays was disclosed by Byrnes in U.S. Pat. No. 6,684,944 issued on Feb. 3, 2004 and U.S. Pat. No. 6,695,046 issued Feb. 24, 2004.

Non-patent unpublished instructions authored by PROCTOR ENGINEERING GROUP, LTD., "CheckMe!® Concept 3—Brush Free DC by McMillan Installation Instructions," Dated: Dec. 31, 2008, Pages 7, Prepared by Proctor Engineering Group Ltd., 418 Mission Ave., San Rafael, Calif. 94901 USA (Proctor 2008a). The Proctor 2008a installation manual is currently available online at: https://www.proctoreng.com/dnld/Concept3_Installation_forCM.pdf. However, the Proctor 2008a was not disseminated or made available to the extent that persons interested and ordinarily skilled in the subject matter or art, exercising reasonable diligence, could locate the reference. Concept 3 motor installation manual describes a variable speed fan motor operating at low speed during fan-off delay. Variable fan speed operation during fan-off delays was disclosed by Byrnes in U.S. Pat. No. 6,684,944 issued on Feb. 3, 2004 and U.S. Pat. No. 6,695,046 issued Feb. 24, 2004.

Non-patent unpublished advertising flier authored by ENERGY FEDERATION INC. (EFI), "Promo—Concept 3 High Efficiency Motor," Date: Jan. 29, 2009, Pages 3, Prepared by Energy Federation Inc. (EFI), 40 Washington St, Westborough, Mass. 01581 USA (EFI 2009). EFI 2009 is a promotional flier for a variable speed motor operating at low speed during fan-off delays which was disclosed by Byrnes in U.S. Pat. No. 6,684,944 issued on Feb. 3, 2004 and U.S. Pat. No. 6,695,046 issued Feb. 24, 2004.

Non-patent unpublished flier authored by PROCTOR ENGINEERING GROUP, LTD., "Promo—Concept 3 PEG Calif-Photo," Date: Nov. 4, 2008, Page 1, Proctor Engineering Group Ltd., 418 Mission Ave., San Rafael, Calif. 94901 USA (Proctor 2008b). Proctor 2008b is a promotional flier for a variable speed motor operating at low speed during fan-off delays. Variable speed fan motor operation during fan-off delays was disclosed by Byrnes in U.S. Pat. No. 6,684,944 issued on Feb. 3, 2004 and U.S. Pat. No. 6,695,046 issued Feb. 24, 2004.

Non-patent unpublished installation manual authored by PROCTOR ENGINEERING GROUP, LTD., "Enhanced Time Delay Relay Installation Procedure," Date: Nov. 28, 2006, Pages 4, Prepared by Proctor Engineering Group Ltd., 418 Mission Ave., San Rafael, Calif. 94901 USA (Proctor 2006). Proctor 2006 is an installation manual for adjustable fixed fan-off delay products.

Non-patent unpublished advertising flier authored by PROCTOR ENGINEERING GROUP, LTD., "Air Conditioner Enhanced Time Delay Relay" (DelayRelayFactSheet 3-LR.pdf), Date: Dec. 31, 2007, Pages 2, Proctor Engineering Group Ltd., 418 Mission Ave., San Rafael, Calif. 94901 USA (Proctor 2007b). This is an advertising document targeting homeowners.

U.S. Pat. No. 6,708,135 (Southworth '135) describes several timer functions (e.g. delay on make, delay on break, recycle, single shot, etc.) expressed in terms of a series of timer subfunctions, and code segments for each subfunction. A program of a timer is established to include a plurality of subfunction code segments and a subfunction ordering table for determining the ordering of execution for the subfunction code segments. The ordering of subfunctions of the subfunction ordering table may be selectable in accordance with a model number input received at a program builder system adapted for use in programming the programmable timer. In one embodiment, the programming method provides for reprogramming of a timer including a control circuit having a one-time programmable processor.

Non-patent publication published by the Florida Solar Energy Center (FSEC) authored by HENDERSON, H., SHIREY, D., RAUSTAD, R., "Understanding The Dehumidification Performance of Air-Conditioner Equipment at Part-Load Conditions," Final Report FSEC-CR-1537-05, Date: January 2006, Pages 613, Florida Solar Energy Center, Cocoa, Fla., USA (Henderson 2006), Available online at: http://www.fsec.ucf.edu/en/publications/pdf/FSEC-CR-1537-05.pdf. Henderson 2006 is cited in CEC '056. Henderson 2006 provides data for a fixed fan-off delay of 26 minutes based on AC compressor operating time of 12 minutes (Figure 6, p. 14).

Non-patent publication published by PACIFIC GAS & ELECTRIC (PG&E) and authored by Abram Conant of PROCTOR ENGINEERING GROUP, LTD., titled "California Climate Air Conditioner Upgrade-Enhanced Time Delay Measure Codes H796 Cooling Optimizer Program, Work Paper PGE3PHVC150 Enhanced Time Delay Relay Revision #1," Date: May 5, 2014, pages 36, published by PG&E Customer Energy Solutions, San Francisco, Calif., USA (PG&E 2014). Available online at: http://deeresources.net/workpapers. PG&E 2014 was published 48 months after the Walsh '229 patent application was filed on Apr. 14, 2010 which issued as the '920 patent. PG&E 2014 is the earliest published Proctor workpaper available that can be located by persons interested and ordinarily skill in the subject matter or art, exercising reasonable diligence. No earlier published references of Proctor workpapers were disseminated or otherwise made available to the extent that persons interested and ordinarily skilled in the subject matter or art, exercising reasonable diligence, could locate the references. PG&E 2014 references an undisclosed proprietary algorithm providing a fan-off delay after the air conditioner compressor turns off. This disclosure of an undisclosed algorithm is almost identical to the disclosure on page 9 of Proctor 2008 regarding an undisclosed proprietary algorithm. PG&E 2014 does not provide an enabling disclosure regarding how "the fan-off time delay is recalculated during every air conditioner cycle as a function of the available cooling capacity remaining on the indoor coil." PG&E 2014 provides field test data for seven homes that "received a device with control characteristics identical to the Western Cooling Control (WCC) Enhanced Time Delay Relay (ETDR) device" (Table 8, pp. 8-9) from a study published in August 2011 by Queen, R., titled "Proportional Time Delay Relay for Air Conditioner Latent Capacity Recovery," Report to the California Energy Commission Public Interest Energy Research Program, August 2011. The Queen report was published 16 months after Walsh filed the provisional '229 patent application on Apr. 14, 2010. PG&E 2014 also provides Intertek laboratory test data from CASE 2011 published in December 2011 or 20 months after the Walsh filed the provisional '229 application on Apr. 14, 2010. PG&E 2014 also provides tests of continuous fan operation with Compressor Pause Mode (CPM) in Figure 5 and Table 11 (p. 13) taken from Table 23 (p. 65) and Figure 48 (p. 66) of the CEC '056. Figure 5 (p. 13) and Figure 48 (p. 66) of the CEC '056 only show the Y-axis from 5.5 to 10. Figure 5 also shows three arrows pointing to a "5 minute tail" and one arrow pointing to a "10 minute tail," but these are not "enhanced time delay tests" as stated in the caption of Figure 5. Rather, these are Compressor Pause Mode (CPM) tests as indicated in an embedded Excel spreadsheet titled "SCE-Data.xls" in PG&E 2014 showing the full lab test data including evaporator fan power and continuous fan operation with compressor pause and the entire Y-axis from 0 to 10 sensible Energy Efficiency Ratio* (EER*) and kW. The CPM method is described on page 21 of PG&E #0603. PG&E 2014 also provides laboratory test data described in Henderson 2006 cited in CEC '056. Henderson 2006 provides data for a fixed fan-off delay of 26 minutes based on AC compressor operating time of 12 minutes.

Non-patent publication published by the CALIFORNIA UTILITIES STATEWIDE CODES AND STANDARDS TEAM, Codes and Standards Enhancement (CASE) Initiative: Residential Refrigerant Charge Testing and Related Issues, 2013 California Building Energy Efficiency Standards, Date: December 2011, pages 51-61, authored by Pacific Gas and Electric (PG&E) Company, San Francisco, Calif., USA (CASE 2011). Available online at: http://www.energy.ca.gov/title24/2008standards/special_case_appliance/refrigerant/2013_CASE_R_Refrigerant_Charge_Testing_Dec_2011.pdf. CASE 2011 was published 20 months after filing the '229 application on Apr. 14, 2010 which issued as the Walsh '920 patent. The CASE 2011 discloses a fixed fan-off delay based on variable AC run time or variable fan-off delay based on fixed AC run time. Cycling test summaries are provided in Appendix C (pp. 60-61) for various fan-off time delay times of 80 to 610 seconds with 6 minutes of compressor run times for all tests with one set of tests using a Permanent Split Capacitance (PSC) motor and one set of tests using a Brushless Permanent Magnet (BPM) motor. Appendix A (pp. 50-54) provides Intertek testing conditions, test descriptions, test date, conditions, and airflow (cfm/ton) indicating the test were performed from Sep. 16, 2010 (p. 50) through Oct. 1, 2010 (p. 54). The Intertek tests provided in Appendix A (pp. 50-54), Appendix B (pp. 55-59), and Appendix C (pp. 60-61) were performed approximately five months after filing the '229 application on Apr. 14, 2010. Page 33 and 34 provide laboratory test data regarding the duct loss effect for fan-off time delay times ranging from 80 to 610 seconds with compressor run times of 6 minutes where one set of tests was performed using a PSC motor (FIG. 20) and another set of tests was performed using a BPM motor (Figure 21).

Non-patent publication published by the International Energy Program Evaluation Conference (IEPEC) and authored by PROCTOR, J., HAIRRELL, A., "An Innovative Product's Path to Market. The influence of laboratory and field evaluations on adoption and implementation," Date: August 2013, pages 7-8, IEPEC, Chicago, Ill., USA (Proctor 2013). Available online at: https://www.iepec.org/conf-docs/conf-by-year/2013-Chicago/050.pdf#page=1. Proctor 2013 was published 40 months after the Walsh '229 application was filed on Apr. 14, 2010 that led to the '920 patent. Proctor 2013 references an undisclosed algorithm embodied in a relay to provide a fan-off delay after air conditioning compressor turns off. Page 8 of the Proctor 2013 report provides the following statement. "In the winter of 2009 fall of 2010 (sic) various time delay lengths were tested at the psychometric test facility in Plano Tex. This facility is regularly used by air conditioning manufacturers to certify their units to Air-Conditioning Heating Refrigeration Institute (AHRI). The facility consists of a climate controlled indoor room and a climate controlled outdoor room. The facility has the ability to cover a wide range of climate conditions from very hot summer conditions to very cold winter conditions. These tests were sponsored by the California Investor Owned Utilities in support of codes and standards." This statement asserts that tests were performed in the "winter of 2009" appears to be a typographical error and is crossed out. Evidence of this typographical error is provided in CASE 2011 Appendix A (pp. 50-54) showing tests dates ranging from Sep. 16, 2010 (p. 50) through Oct. 1, 2010 (p. 54). Furthermore, Robert Mowris, Verified Inc., was the first client to use the new Intertek psychrometric test facility in Plano, Tex., from February through March 2010. The Intertek tests provided in Appendix A (pp. 50-54) of the CASE 2011 report were performed approximately five months after the '229 application was filed on Apr. 14, 2010. The Proctor relay product was labeled with Southworth U.S. Pat. No. 6,708,135. The Southworth '135 patent applies to a timer that has the ability to be field programmed, but does not monitor any inputs nor does the patent vary the fan time delay based on the inputs. The Southworth '135 patent was assigned to ABB, an international company. Within ABB, the relay division was called SSAC, and SSAC was acquired by Symcom which was subsequently acquired by Littelfuse. SymCom manufactured at least two part numbers for Proctor Engineering Group. The first part number is KRLS2C-4713 with date code "4510" indicating first date of manufacturing was the 45th week of 2010. The second part number is KRLS2C-4827 with date code "4412" indicating first date of manufacturing was the 44th week of 2012. The first part number KRLS2C-4713 provided two optional variable fan-off delays of 4 to 10 minutes and 2 to 5 minutes. The second part number KRL2S2C-4827 provided a variable fan-off delay of 2 to 5 minutes. SymCom Technical Support indicated that the date code is ""WWYY" so "4510" is 45th week of 2010. Therefore, the first product KRL2S2C-4713 with a variable fan-off time delay relay reprogrammed "to follow the algorithm that related the fan run time to the compressor run time" was first manufactured in November 2010. This is approximately seven months after the Walsh '229 application was filed on Apr. 14, 2010.

Non-patent installation instructions published by CARRIER CORPORATION for a packaged HVAC system "48ES-A Comfort 13 SEER Single-Packaged Air Conditioner and Gas Furnace System with Puron®-410A Refrigerant Single and Three Phase 2-5 Nominal Tons (Sizes 24-60), 48ES-A Installation Instructions," date: September 2010, Page 23 (CARRIER 2010). Available online at: http://dms.hvacpartners.com/docs/1009/Public/0E/48ES-0551.pdf. CARRIER 2010 discloses a method of changing the fan speed by selecting a fan speed tap on the motor and connecting it to the blower relay.

Non-patent publication by Venstar® Inc., for an electro-mechanical Add-a-Wire™ product that costs from $21 to $99. In applications where additional wiring cannot be installed, the Add-A-Wire™ accessory can be used to add a wire to the thermostat. See https://venstar.com/thermostats/accessories/add-a-wire/.

Non-patent publication by Lux Products Corporation for an electro-mechanical Power Bridge product that costs from $18 to $22. The LUX Power Bridge provides 24V AC power to thermostats in homes without C-wires. Thermostats that connect to WiFi networks and home automation systems like Amazon Alexa and Apple HomeKit need a consistent 24V AC power source for optimal performance. The LUX Power Bridge allows homes with 3 and 4 wire systems to reap the benefits of smart thermostats without requiring a new wire to be installed between the furnace and the thermostat. See https://pro.luxproducts.com/powerbridge/.

Non-patent publication by Honeywell International Inc., for an electro-mechanical WireSaver THP9045A1023/U wiring module that costs $12 to $16 but only works with Honeywell thermostats and does not provide a connector at the thermostat for other manufacturers. The Honeywell WireSaver is a C-Wire Adapter for WiFi thermostats or RedLINK 8000 series Honeywell thermostat models. See https://customer.honeywell.com/en-US/Pages/Product.aspx?cat=HonECC+Catalog&pid=thp9045a1023/U.

Non-patent publication by Ecobee Inc., for an electromechanical EBPEK01 Smart SI Power Extender Kit that costs $20 to $27. A common wire is required for 5-wire thermostats. If there are only 4 wires to the existing thermostat (i.e. there is no common wire), the Ecobee Power Extender Kit can be used to power the Ecobee WiFi thermostat. See https://support.ecobee.com/hc/en-us/articles/227874107-Installing-the-Power-Extender-Kit-with-ecobee-Si-thermostats.

U.S. Pat. No. 9,410,713 (Lau '713) abstract discloses an "integrated efficient fan controller circuit device for controlling a fan of a heating, ventilating and air conditioning (HVAC) system." The '713 patent describes and claims a fan controller having well-known circuit elements and configurations. Before the filing date of the '713 patent (Aug. 30, 2013), fan controllers for HVAC systems had already existed. The fan controller disclosed and claimed by the '713 patent, including each of the circuit components and their connections were either known or obvious to a person of ordinary skill based on decades-old circuit theory or disclosed in U.S. Pat. No. 8,763,920 (Walsh '920), issued on Jul. 1, 2014 from an application filed on Apr. 12, 2011 and claiming priority from a provisional application, 61/324,229, filed on Apr. 14, 2010.

U.S. Pat. No. 10,047,969 (Lau '969) discloses a "method and apparatus for controlling an air handler including a fan and at least a member of a group consisting of a heater and a compressor, the method comprising: installing an energy saving controller ("ESC") between a thermostat and the air handler, monitoring by the ESC of ON and OFF durations of the heater if the air handler is in a heating mode, or the compressor if the air handler is in cooling mode, in a previous cycle and of ON duration of a current cycle, and determining the fan's first run time extension amount based on the ON and OFF durations of the previous cycle and the ON duration of the current cycle."

U.S. Patent Application Publication No. 20150060557 (Lau '557 publication) discloses a "method for energy saving during the operation of an HVAC system comprising an energy saving unit, comprising: installing a temperature probe in the supply air that can send data to the energy saving unit; configuring the energy saving unit to perform a set of functions comprising: receiving a user's instructions for turning on the HVAC system and setting a target room temperature; shutting off the heater or compressor when the target temperature is reached; measuring the temperature of the air in the room that is being heated or cooled and comparing the temperature of the supply air with the temperature of the air in the room; and causing the blower to keep running after shutting off the heater or compressor for as long as the temperature of the air in the room is smaller or greater than the temperature of the supply air, respectively."

U.S. Pat. No. 10,119,719 (Lau '719) discloses an "energy saving controller for an air handler having a fan and a heater or a compressor, the energy saving controller having circuitry for monitoring of ON and OFF durations of the heater if the air handler is in a heating mode, or the compressor if the air handler is in a cooling mode, in a previous cycle, and, of ON duration of a current cycle, and determining the fan's first run time extension based on the ON and OFF durations of the previous cycle and the ON duration of the current cycle. The '219 publication was filed Apr. 7, 2016 about five years after the Walsh U.S. patent application Ser. No. 13/085,119 was filed on Apr. 12, 2011 with provisional application No. 61/324,229 filed on Apr. 14, 2010 that led to U.S. Pat. No. 8,763,920 (the '920). The '920 patent discloses "monitoring a duration of the air conditioner compressor cycle; and determining an amount of time fan operation is extended after the cooling cycle based on the duration" where the cooling cycle includes the OFF and ON duration. U.S. Pat. No. 9,995,493 (the '493) is a continuation in part from the '920 patent. The '493 patent discloses a heating fan-off delay P2 "based on at least one heating cycle duration selected from the group consisting of: a heating on time defined from when the thermostat initiates a call for heating until the thermostat terminates the call for heating, and a heating off time defined from when the thermostat terminates the call for heating until the thermostat initiates the call for heating plus the heating on time."

U.S. Pat. No. 10,066,849 (Lau '849) discloses an "energy saving controller configured for mounting between a thermostat and the controller for an air handler unit having a fan and at least a member of a group consisting of a heater and a compressor. The energy saving controller includes a temperature probe for reading the temperature of a room where the thermostat is located and being configured to control the air handler unit based on a demand response request received from a utility provider via the Internet and an input from the temperature probe." Known air handlers are controlled by thermostats which have a temperature sensor. Smart communication thermostats devices with temperature sensors and WIFI technology for wireless local area networking based on the IEEE 802.11 are enabled to control air handler units based on a demand response request received from the thermostat manufacturer (i.e., Nest, ecobee, Venstar) or a utility provider.

U.S. Pat. No. 10,174,966 (Lau '966) discloses an "An energy saving controller for an air handler having a heater and a dual speed fan adapted to switch between a first speed and a second higher speed via a gas furnace controller, the energy saving controller being configured to be mounted between a thermostat and the gas furnace controller, and having: input terminals configured to connect to corresponding thermostat output terminals and receive output signals; a microcontroller configured to: process the output signals into revised signals; and cause the gas furnace controller to alternate between the first speed and the second higher speed to mimic a behavior of a variable speed fan; drivers configured to receive the revised signals and use the revised signals to actuate mechanical relays; wherein the mechanical relays are configured to actuate the fan or the compressor via ESC output terminals; and means for causing the alternation."

U.S. Pat. No. 6,415,617 (Seem '617) discloses a method for controlling an air-side economizer of an HVAC system using a model of the airflow through the system to estimate building cooling loads when minimum and maximum amounts of outdoor air are introduced into the building and uses the model and a one-dimensional optimization routine to determine the fraction of outdoor air that minimizes the load on the HVAC system. The '617 patent does not provide apparatus or methods to measure the Outdoor Air Fraction (OAF) defined as the ratio of outdoor airflow through the economizer or non-economizer dampers to total system airflow. Nor does the '617 patent provide methods to adjust the economizer outdoor air damper minimum damper position until OAF is within the allowable minimum regulatory requirement.

U.S. Pat. No. 7,500,368 filed in 2004 and issued in 2009 to Robert Mowris (Mowris '368) discloses a method for diagnosing and correcting airflow faults to ensure proper airflow prior to determining whether or not to diagnose refrigerant charge faults and determine an amount of refrigerant charge to add or remove based on factory charge and return and supply air temperature measurements and refrigerant system temperature and pressure measurements (col 2:27-37). The '368 patent does not disclose a method to diagnose refrigerant charge faults with low airflow outside accepted tolerances which can cause insufficient evaporation of refrigerant inside the evaporator coil and cause low superheat and high subcooling and "false alarm" overcharge diagnostics.

US Patent Application Publication No. 2015/0, 309,120 (Bujak '120 publication) discloses a method to evaluate economizer damper fault detection for an HVAC system including moving dampers from a baseline position to a first damper position and measuring the fan motor output at both positions to determine successful movement of the baseline to first damper position. The '120 publication does not teach how to measure the OAF or electronically control the actuator to adjust the economizer outdoor air damper minimum damper position until OAF is within the allowable minimum regulatory requirement.

Carrier. 1995. HVAC Servicing Procedures. SK29-01A, 020-040 (Carrier 1995). The Carrier 1995, page 149-150, describes the "Proper Airflow Method" (pp. 7-8 of PDF) based on measuring temperature split and hereinafter referred to as the TS method. The TS method focuses entirely on measuring temperature split to determine if there is proper airflow and does not mention that temperature split can be used to detect low cooling capacity or other faults. The TS method is recommended after the subcooling Thermostatic eXpansion Valve (TXV) or superheat (non-TXV) (fixed orifice or capillary tube) refrigerant charge diagnostic methods are performed (pp. 145-149). The TS method was first required in the 2000 CEC Title 24 standards, only to check for proper airflow not for proper cooling capacity. The Carrier 1995, page 145-148, describes "Checking the Refrigerant Charge Using the Superheat Method (Non-TXV Systems)" and "Checking the Refrigerant Charge Using the Subcooling Method (TXV Systems)." The Carrier methods are used as the basis for the California Energy Commission (CEC) Refrigerant Charge Airflow (RCA) protocol required by the Building Energy Efficiency Standards for Residential and Nonresidential Buildings (see below).

California Energy Commission (CEC). 2008. 2008 Residential Appendices for the Building Energy Efficiency Standards for Residential and Nonresidential Buildings. CEC-400-2008-004-CMF, California Energy Commission, Sacramento, Calif.: pp. RA3-9 to RA3-24 (CEC 2008). The CEC 2008 report provides a Refrigerant Charge Airflow (RCA) protocol disclosed in the Carrier 1995 HVAC Servicing Procedures document and defined in Appendix RA3 of the CEC 2008 Building Energy Efficiency Standards, which is a California building energy code. The Temperature Split (TS) method is used to check for minimum airflow across the evaporator coil in cooling mode per pp. RA3-15, Section RA3.2.2.7 Minimum Airflow. Temperature split is defined as the measured return air temperature (evaporator entering air temperature) minus the measured supply air temperature (evaporator leaving air temperature). The SuperHeat (SH) method is used to check refrigerant charge in cooling mode for fixed metering devices per pp. RA3-9 through RA3-14, Section RA3.2.2. The superheat is defined as the measured suction line temperature minus the evaporator saturation temperature and evaporator saturation temperature is based on the measured refrigerant suction line pressure. The Subcooling method is used to check refrigerant charge in cooling mode for variable metering devices including Thermostatic Expansion Valves (TXV) and Electronic Expansion Valves (EXV) per pp. RA3-14 to RA3-15, Section RA3.2.2. The subcooling is defined as the condenser saturation temperature minus the measured liquid line temperature and condenser saturation temperature is based on the measured refrigerant liquid line pressure. The required subcooling is specified by the manufacturer or if not available it is assumed to be 10 degrees Fahrenheit. CEC 2008 provides a table of required temperature split values on page RA3-19 based on measured return air wetbulb and return air drybulb temperature measurements. See Table RA3.2-3 Target Temperature Split (Return Dry-Bulb—Supply Dry-Bulb). The CEC provides a table of required superheat values on page RA3-17 and RA3-18 based on measured return air wetbulb and condenser entering air drybulb temperature measurements. See Table RA3.2-2 Target Superheat (Suction Line Temperature—Evaporator Saturation Temperature). In 2013, the CEC adopted the 2013 Building Energy Efficiency Standards and no longer allowed the TS method to check for minimum airflow due to the perceived inaccuracy of the TS method as disclosed in the Yuill 2012 report (see below).

Yuill, David P. and Braun, James E., 2012. "Evaluating Fault Detection and Diagnostics Protocols Applied to Air-Cooled Vapor Compression Air-Conditioners." International Refrigeration and Air Conditioning Conference. Paper 1307. http://docs.lib.purdue.edu/iracc/1307. (Yuill 2012). The Yuill 2012 report evaluated the Refrigerant Charge Airflow (RCA) protocol including the TS method specified in the Appendix RA3 of the CEC 2008 Building Energy Efficiency Standards, which is the California building energy code. Yuill applied the TS method to cooling mode air-conditioners to determine whether an evaporator airflow fault (EA) is present, and if none is present to determine whether a refrigerant charge fault is present (UC or OC). Yuill 2012 evaluated the accuracy of correctly diagnosing evaporator airflow (EA) faults from −10% to −90% of proper airflow. Page 7 of the Yuill 2012 report makes the following statement: "The results, overall, seem quite poor. About half of the times it's applied, the RCA protocol gives a correct result. The most serious problems are the high rates of False Alarm and Misdiagnosis (30% and 33%), because each of these outputs will result in costly and unnecessary service when the protocol is deployed. In practice, users of FDD on unitary equipment commonly have no tolerance for False Alarms, but are quite tolerant of Missed Detections, so it could be concluded that this protocol is overly sensitive." Yuill reported that the TS method was 100% accurate for diagnosing low airflow from −50 to −90%, but the accuracy was unacceptable for diagnosing low airflow from −10 to −40%. The Yuill 2012 report identified: "a great need for a standardized method of evaluation, because it is likely that better-performing methods currently exist, or could be developed, and could take the place of RCA, but with no method of evaluating them it is impossible to know what those methods are." Based on the Yuill 2012, the CEC, HVAC industry experts, and persons having ordinary skill in the art no longer recommended using the TS method for checking "proper airflow" or any other fault. In 2013, the CEC Title 24 standards mentioned the TS method, but did not allow this method to be used for field verification of proper airflow. Nor did the CEC recommend using the TS method to check low capacity or other faults. Instead the CEC required other methods for field verification of proper airflow. From 2000 through 2018, the CEC has not recommended or required using the TS method to diagnose low capacity faults caused by low refrigerant charge, dirty air filters, blocked evaporator or condenser coils, low refrigerant charge, iced evaporator, faulty expansion device, restrictions, non-condensables, duct leakage, excess outdoor airflow or low thermostat setpoint which cause longer compressor operation and wasted energy.

California Energy Commission. 2012. Reference Appendices The Building Energy Efficiency Standards for Residential and Nonresidential Buildings. CEC-400-2012-005-CMF-REV3. (CEC 2012). CEC 2012 reference appendices of the building standards page RA3-27-28 require the following methods to measure airflow: 1) supply plenum pressure measurements are used for plenum pressure matching (fan flow meter), 2) flow grid measurements (pitot tube array "TrueFlow"), 3) powered-flow capture hood, or 4) traditional flow capture hood (balometer) methods to verify proper airflow. CEC 2012 required supply plenum pressure measurements to be taken at the supply plenum measurement access locations shown in FIG. RA3.3-1. These holes were previously used to measure temperature split (TS), but TS is not required since the CEC and persons having ordinary skill in the art do not believe the TS method provides useful information.

R. Mowris, E. Jones, R. Eshom, K. Carlson, J. Hill, P. Jacobs, J. Stoops. 2016. Laboratory Test Results of Commercial Packaged HVAC Maintenance Faults. Prepared for the California Public Utilities Commission. Prepared by Robert Mowris & Associates, Inc. (RMA 2016). The RMA 2016 laboratory study states that the TS method was accurate 90% of the time when diagnosing low airflow (cfm) and low cooling capacity (Btu/hr) faults including excess outdoor air ventilation, blocked air filters or coils, restrictions, non-condensables, low refrigerant charge, or other cooling system faults. Page iii of the RMA 2016 abstract makes the following statement. "The CEC temperature split protocol average accuracy was 90+/−2% based on 736 tests of faults causing low airflow or low capacity." However, the RMA 2016 report indicated that the CEC refrigerant charge protocol method average accuracy was 31+/−4% based on 445 tests and the manufacturer refrigerant charge protocol average accuracy was 45+/−3% based on 992 tests. Most importantly, the RMA 2016 report showed that low airflow was misdiagnosed most of the time, and low airflow faults caused "false alarm" overcharge faults 100% of the time indicating an unresolved need for more accurate diagnostic methods. Due to the poor performance of the TS method for checking low airflow from −10 to −40% as disclosed by Yuill 2012, starting in 2013, the CEC no longer requires using the TS method to check minimum airflow. Instead the CEC requires direct measurement of airflow using one of the following methods: 1) supply plenum pressure (fan flow meter), 2) flow grid measurements (pitot tube array "TrueFlow"), 3) powered-flow capture hood, or 4) traditional flow capture hood (balometer).

U.S. Pat. No. 7,444,251 (Nikovski '251) discloses a system and method to detect and diagnose faults in HVAC equipment using internal state variables under external driving conditions using a locally weighted regression model and differences between measured and predicted state variables to determine a condition of the HVAC equipment. The '251 patent does not provide apparatus or methods to measure the OAF. The '251 patent does not provide apparatus or methods to measure the OAF. Nor does the '251 patent provide methods to adjust the economizer outdoor air damper minimum damper position until OAF is within the allowable minimum regulatory requirement or measure the temperature difference across the evaporator or heat exchanger to determine whether or not the sensible cooling or heating capacities are within tolerances.

U.S. Pat. No. 6,223,544 (Seem '544) discloses an integrated control and fault detection system using a finite-state machine controller for an air handling system. The '544 method employs data regarding system performance in the current state and upon a transition occurring, determines whether a fault exists by comparing actual performance to a mathematical model of the system under non-steady-state operation. The '544 patent declares a fault condition in response to detecting an abrupt change in the residual which is a function of at least two temperature measurements including: outdoor-air, supply-air, return-air, and mixed-air temperatures. The '544 patent measures the mixed-air temperature with a single-sensor and without a minimum temperature difference between outdoor and return air temperatures. The '544 patent does not provide apparatus or accurate methods to measure the OAF. Nor does the '544 patent provide methods to adjust the economizer outdoor air damper minimum damper position until the OAF is within the allowable minimum regulatory requirement or measure the temperature difference across the evaporator or heat exchanger to determine whether or not the sensible cooling or heating capacities are within tolerances.

U.S. Pat. No. 8,972,064 (Grabinger et al '064) discloses a system incorporating an actuator which may have a motor unit with motor controller and a processor and the processor may incorporate a diagnostics program that may communicate from the processor over a communications bus to a system controller where diagnostic results may communicate an insufficiency of the actuator, where an alarm identifies the insufficiency. The '064 patent provides an insufficiency of the actuator based on an encoder on the actuator shaft used to determine the actuator angle of the actuator shaft.

U.S. patent application Ser. No. 15/217,770 (Gevelber '770) discloses an airflow system including a damper apparatus configured to adjust a flow volume of recirculated air and a flow volume of outside air within the airflow system, a Variable Air Volume (VAV) apparatus disposed in fluid communication with the damper apparatus, and a controller disposed in operative communication with the damper apparatus and the VAV apparatus (Also see US Patent Application Publication No. 2017/00232069). The '770 application discloses a controller is configured to determine a percentage of outside air provided to the airflow system by the damper apparatus (based on actuator position from 0% closed to 100% open), determine a minimum flow volume provided by the VAV apparatus of the airflow system, which relates a required flow volume of outside air provided by the VAV apparatus to a zone and the percentage of outside air provided to the airflow system by the damper apparatus, and adjust a flow volume of air provided by the VAV apparatus to the zone based upon the determined minimum flow volume provided by the VAV apparatus. The '770 application applies to a VAV system where the Outdoor Airflow Percentage (OA %) is based on the damper actuator position and the assumed actuator damper position is used to calculate the mixed air temperature (Tmix) based on the measured outdoor air temperature (Toa) and the measured return air temperature (Tr) where, Tmix=Tr−OA % (Toa−Tr). The '770 assumes OA % is 100% when dampers are fully open and 0% when dampers are fully closed and intermediate OA % is simply the damper location between these economizer damper actuator positions which vary from 0 to 100% open.

Pacific Northwest National Laboratory (PNNL 2014, PNNL-SA-88958) '958 discloses a method to measure the Outdoor Air Fraction (OAF) based on the ratio of the difference between the Mixed Air Temperature (Tmix) and the return air temperature (Tr) divided by the difference between the Outdoor Air Temperature (Toa) and Tr, i.e., OAF=(Tmix−Tr)/(Toa−Tr). PNNL discloses that the OAF measurement is only meaningful when the Toa is significantly different than the Return Air Temperature (RAT) (i.e., greater than +/−5 F). PNNL '958 discloses a Figure 1, where the "OAF tracks the Outdoor Air Damper (OAD) position signal fairly well, although when the damper is fully open, the OAF is not 100%. There are number of possible reasons for this difference: 1) accuracy of temperature sensors, 2) location of temperature sensors and possibility that the damper may not be fully open even signaled to open 100%." PNNL '958 page 3, discloses an accepted tolerance of the required OAF per regulatory standards within plus or minus 10% to 15% of the minimum required OAF per regulatory standards (See PNNL '958, page 3, "if the OAF is within +/−10% to 15% of expected value, it should be considered reasonable").

Pacific Northwest National Laboratory (PNNL 2013, S. Katipamula et al PNNL-22941) discloses a method to detect Automated Fault Detection Diagnostics (AFDD) for comparing discharge-air temperatures with mixed-air temperatures for consistency, check if outdoor-air damper is modulating, detect Roof Top Unit (RTU) sensor faults (outside-, mixed- and return-air temperature sensors), detect if the RTU is not economizing when it should, detect if the RTU is economizing when it should not, detect if the RTU is using excess outdoor air, detect if the RTU is bringing in insufficient outdoor air, and automated Demand Response (DR).

U.S. Pat. No. 4,773,587 (Lipman '587) discloses a method to compare conditioned space temperature to a supply air duct temperature per Col. 2 Lines 39:49: "Briefly, the heat or air conditioning system is actuated by a thermostat located inside a building, as is the fan or blower. Further, this thermostat also actuates a circuit which is also controlled by a sensor located within the duct work. After the temperature within the building reaches the desired level, and the building thermostat opens, the heating or air conditioning system is deactivated. The circuit remains energized, and if the sensor which is located in the duct work is closed in response to the presence of heated or cooled air in the duct, this circuit causes the fan to continue to run until the sensor opens in response to the duct temperature rising to the predetermined level (in the case of air conditioning) or falling to the predetermined level (in the case of heat). When the sensor opens, the circuit is de-energized, so that if the sensor subsequently closes in response to the ambient air temperature of the duct work changing, the fan will not be activated."

M. Rezagholizadeh, K. Salahshoor and E. M. Shahrivar, "A fault detection and diagnosis system based on input and output residual generation scheme for a Continuous Stirred Tank Reactor (CSTR) benchmark process," 2010 IEEE International Conference on Mechatronics and Automation, Xi'an, 2010, pp. 1898-1903. doi: 10.1109/ICMA.2010.5588956. URL: http://ieeexploreleee.org/stamp/stamp.jsp?tp=&arnumber=5588956&isnumber=5587913.

Abstract: "Aim of this study is to propose Fault Detection and Diagnosis (FDD) algorithm based on input and output residuals that consider both sensor and actuator faults separately. The existing methods which have capability of fault diagnosis and its magnitude estimation suffer from great computational complexity, so they would not be practical for the real-time applications. The proposed method in this paper has the advantage of simple structure and straightforward computations but at the cost of losing precision. The introduced approach incorporates an auxiliary-PI controller in a feedback configuration with an Extended Kalman Filter (EKF) algorithm to constitute an Actuator Input-output Residual Generator (AIORG) unit. Similarly, a sensor output residual generator (SORG) unit is realized with an EKF-based algorithm to cover for simultaneous sensor possible faults. The generated residuals are then fed to a FDD unit to extract diagnostic and fault estimation results using a threshold-based inference mechanism. A set of test scenarios is conducted to demonstrate the performance capabilities of the proposed FDD methodology in a simulated Continuous Stirred Tank Reactor (CSTR) benchmark against sensor and actuator faults."

Thus, known methods currently do not exist to evaluate low cooling or heating capacity faults which are common faults on many HVAC systems and adjust fan operation accordingly to provide a reliable solution to meet the unresolved need.

BRIEF SUMMARY OF THE INVENTION

The Fault Detection Diagnostic (FDD) method addresses the above and other needs by providing a method of detecting a fan-on setting, optionally reporting a fan-on setting, overriding a fan-on setting, and turning off a Heating, Ventilating Air Conditioning (HVAC) fan for a fraction of a fan-on setting duration. The method also provides or adjusts a variable fan-off delay for a HVAC system. The FDD method compares a previously monitored HVAC parameter to a current HVAC parameter, and if a fault is detected, then the FDD method performs at least one action selected from the group consisting of: correcting the faults such as turning off a HVAC fan for a fraction of a fan-on setting duration, adjusting a variable fan-off delay P2 at the end of a heating on cycle or a cooling on cycle, or other correction to improve energy efficiency. The FDD corrective actions are based on at least one HVAC parameter selected from the group consisting of: an off cycle time P11, a fan-on operating time or a fan-on duration F6, a heating cycle duration P3 including at least one heating cycle selected from the group consisting of: a thermostat call for heating, a heating on cycle, and a heating off cycle, a cooling cycle duration P4 including at least one cooling cycle selected from the group consisting of: a thermostat call for cooling, a cooling on cycle, and a cooling off cycle, and a Conditioned Space Temperature (CST) drybulb temperature measurement or threshold selected from the group consisting of: the CST reaches a heating fan-off delay differential offset, the CST reaches a cooling fan-off delay differential offset, the CST crosses the upper heating differential at least once after the heating cycle, the CST crosses the lower cooling differential at least once after the cooling cycle, and the CST reaches an inflection point where the rate of change of the CST with respect to time equals zero plus or minus a confidence interval tolerance. The HVAC parameters can also include: a supply air temperature, a return air temperature, a temperature split across an evaporator (return air minus supply air temperature), a temperature rise across a heat exchanger (supply air minus return air temperature), an outdoor air temperature, a thermostat temperature, a rate of change of return or supply air temperature, temperature rise, HVAC system electrical power, airflow, air velocity, sound level, vibration, or refrigerant pressures and temperatures.

The FDD method adjusts the variable fan-off delay based on the presence or absence of HVAC faults or severe weather conditions that can impact cooling or heating capacity and the cooling or heating cycle duration causing a low cooling capacity, a low heating capacity, a cooling short cycle, a heating short cycle, a long cooling operating time, or a long heating operating time.

The FDD method may be embodied within a fan controller, a furnace control board, a Forced Air Unit (FAU) control board, a thermostat, a software application, or a HVAC fan motor. Virtually all HVAC systems currently installed in have a circulation fan used to move a quantity of unconditioned return air over a heat exchanger or an evaporator, to condition and reduce the air temperature and humidity for cooling and increase the air temperature for heating. Most systems have faults that occur as the system is operated or non-routine errors or faults that operators introduce to the system such as a fan on continuously during occupied or unoccupied periods without a thermostat call for cooling or heating. These faults can reduce cooling or heating system capacity and efficiency, cause longer cooling or heating system operation, and increase cooling and heating energy use. HVAC faults can reduce the temperature of the heat exchanger and cause less available useful heating energy to be delivered to the conditioned space during the heating on cycle and during the heating fan-off delay period. HVAC faults can also increase the temperature of the evaporator, cause less water to condense on the evaporator, and cause less available useful cooling energy to be delivered to the conditioned space during the cooling on cycle and during the cooling fan-off delay period. The FDD method monitors and detects the presence of HVAC faults and turns off a fan accidentally left on and also provides a variable fan-off delay at the end of the cooling or heating cycle where the fan-off delay varies based on the presence or absence of HVAC faults.

The main objects of the method are:

(1) to provide a reliable and efficient method to diagnose and detect HVAC system faults that reduce cooling or heating system capacity and efficiency;

(2) to control a fan operation when sensible cooling capacity or heating capacity are below a threshold;

(3) to detect and diagnose a fan-on setting, provide an optional FDD alarm fan-on message, override a fan-on setting, and turn off an HVAC fan for 0 to 100% of the fan-on setting duration; and (4) to provide a variable fan-off delay after a cooling on cycle or a heating on cycle to improve energy efficiency wherein the variable fan-off delay is ended based on comparing a temperature measurement of a Conditioned Space Temperature (CST) to a CST threshold.

BRIEF DESCRIPTION OF THE SEVERAL VIEWS OF THE DRAWING

The above and other aspects, features and advantages of the variable fan-off delay or FDD method will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the Fault Detection Diagnostic (FDD) method. This description is not to be taken in a limiting sense, but is made merely for the purpose of describing one or more preferred embodiments of the method. The scope of the method should be determined with reference to the claims.

Where the terms "about" or "generally" are associated with an element of the FDD method, it is intended to describe a feature's appearance to the human eye or human perception, and not a precise measurement.

Figure 1:
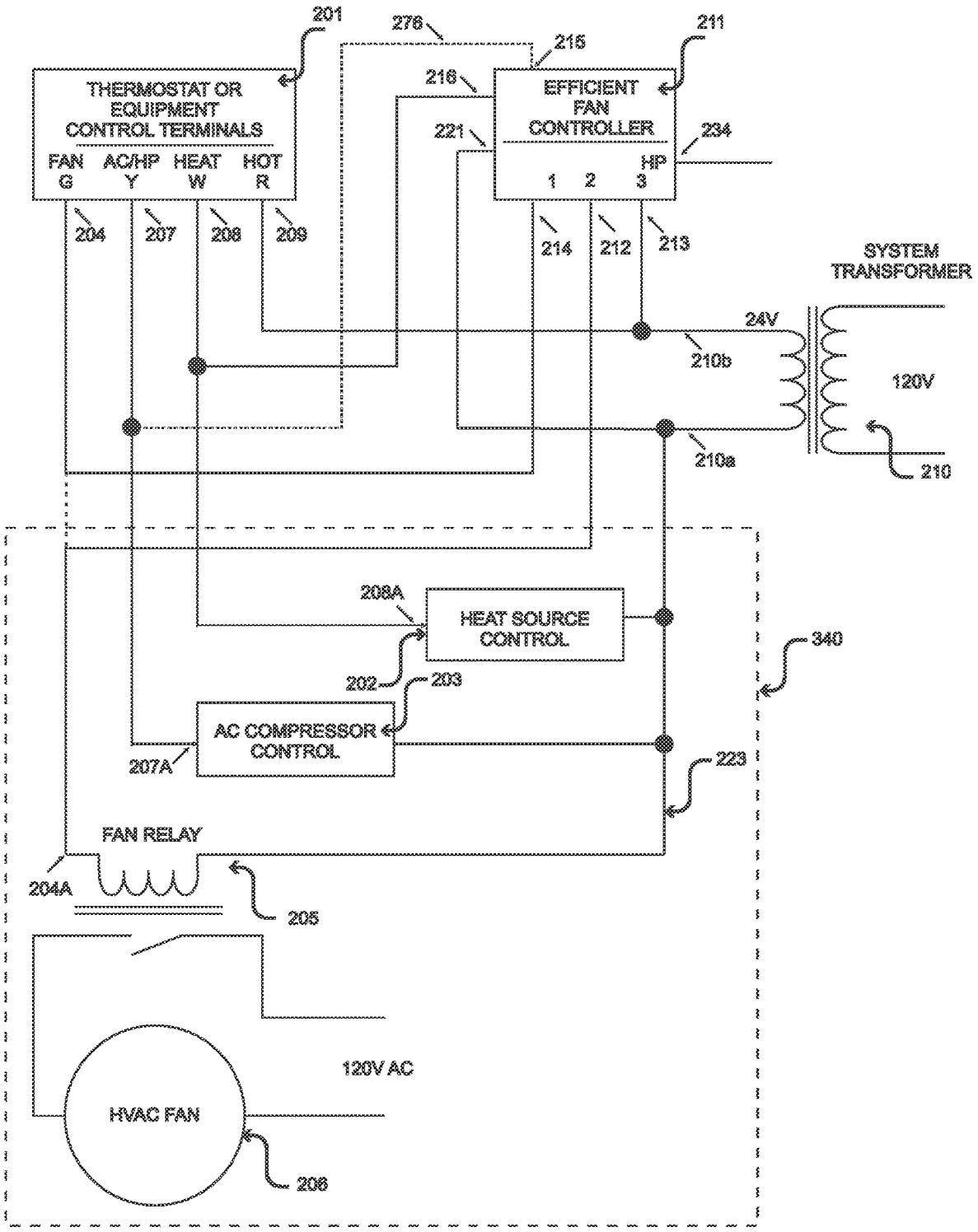
FIG. 1 shows the efficient fan controller connected to a Heating, Ventilation, Air Conditioning (HVAC) system with a gas furnace, an electric resistance, or an hydronic heating system.

FIG. 1 shows the efficient fan controller 211 connected to a Heating, Ventilating, Air Conditioning (HVAC) system with an Air Conditioning (AC) compressor or AC compressor control 203 for direct-expansion cooling and the heat source control 202 for a gas furnace, an electric resistance, or a hydronic heating system. The HVAC system 340 is shown as a dashed line with the heat source control 202, the AC compressor control 203, the fan relay 205, and the HVAC fan 206. The thermostat or equipment control terminals 201 are connected and transmitting an active thermostat control signal or an inactive thermostat control signal using analog 24 Volts Alternating Current (VAC) signals to the efficient fan controller 211 inputs: 1) the fan G terminal 204 transmits an active fan signal from the thermostat or inactive fan signal from the thermostat to the input 204A of the fan relay 205 or to the fan G input 214, 2) the AC/HP Y terminal 207 transmits an active AC/HP compressor signal from the thermostat or inactive AC/HP compressor signal from the thermostat to the input 207A of the AC compressor control 203 or to the AC/HP Y input 215 using an optional wire 276, 3) the heat W terminal 208 transmits an active heating signal from the thermostat or inactive heating signal (or gas heating signal) from the thermostat to the input 208A of the heat source control 202 or to the heat W input 216, 4) the common terminal 210*a* from the system transformer 210 connects to the COM B input 221 and also connects using the wire 223 to the heat source control 202 and the AC compressor control 203 and the fan relay 205, and 5) the hot R terminal 209 from the system transformer 210 connects to the hot R input 213. The Hot R terminal 209 can be optionally connected to the HP input 234 to enable fan control for a Heat Pump (HP) system. The dashed line 217 indicates where the original thermostat fan signal wire to the fan relay 205 has been disconnected to connect this signal to the efficient fan controller 211 and transfer control of the fan relay 205 and the HVAC fan 206 to the efficient fan controller 211. The efficient fan controller 211 transmits a 24 VAC control signal to the fan relay 205 through the fan signal output 212 of the efficient fan controller 211.

Figure 2:
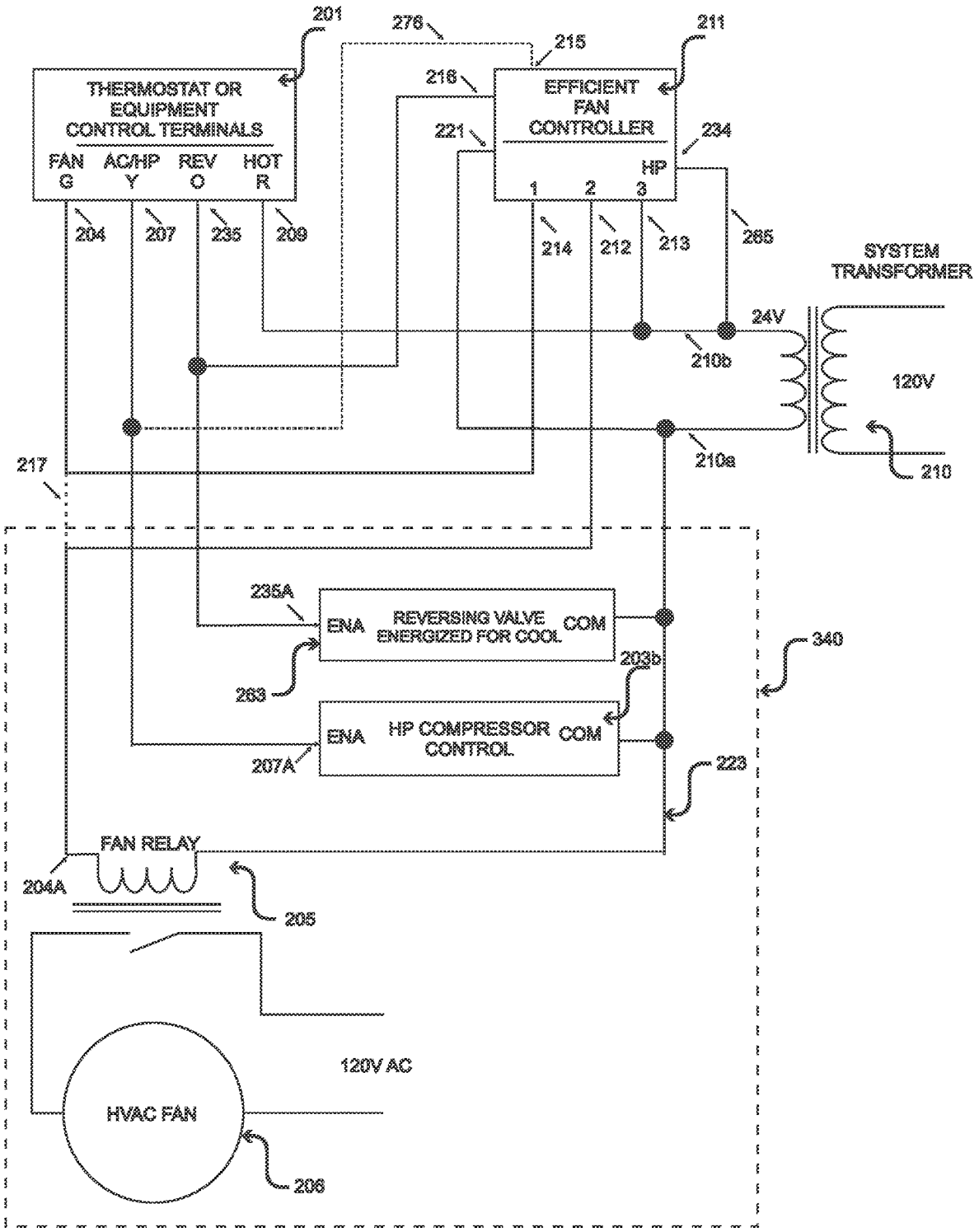
FIG. 2 shows the efficient fan controller connected to a Heat Pump (HP) HVAC system with reversing valve energized for cooling.

FIG. 2 shows the efficient fan controller 211 connected to an HVAC system with an HP compressor control 203*b* for Direct Expansion (DX) cooling and heating and a reversing valve 263 energized for cooling. The HVAC system 340 is shown as a dashed line with the reversing valve 263 energized for cooling, the HP compressor control 203*b*, the fan relay 205, and the HVAC fan 206. The efficient fan controller 211 is connected to the thermostat or equipment control terminals 201 which transmit an active thermostat control signal or an inactive thermostat control signal using 24 VAC analog signals to the efficient fan controller 211 inputs: 1) the fan G terminal 204 connects to the input 204A of the fan relay 205 or to the fan G input 214, 2) the AC/HP Y terminal 207 connects to the input 207A of the HP compressor control 203*b* or to the AC/HP Y input 215 using an optional wire 276, 3) the REV O terminal 235 connects to the input 235A of the reversing valve 263 or to the heat W input 216, 4) the common terminal 210*a* from the system transformer 210 connects to the COM B input 221 and also connects using the wire 223 to the reversing valve 263 and the HP compressor control 203*b* and the fan relay 205, and 5) Hot R terminal 209 from the system transformer 210 connects to the hot R input 213. The hot R terminal 209 may also be connected to the HP input 234 using the wire 265. If the efficient fan controller 211 detects current flowing in both the positive cycle and negative cycle on the HP input 234, then the efficient fan controller 211 uses this signal to detect a HP system with the reversing valve 263 energized for cooling. The dashed line 217 indicates where the original thermostat fan signal wire to the fan relay 205 has been disconnected in order to route this signal to the fan G input 214 of the efficient fan controller 211. The efficient fan controller transmits a 24 VAC control signal through the fan signal output 212 to control the fan relay 205 and the HVAC fan 206.

Figure 3:
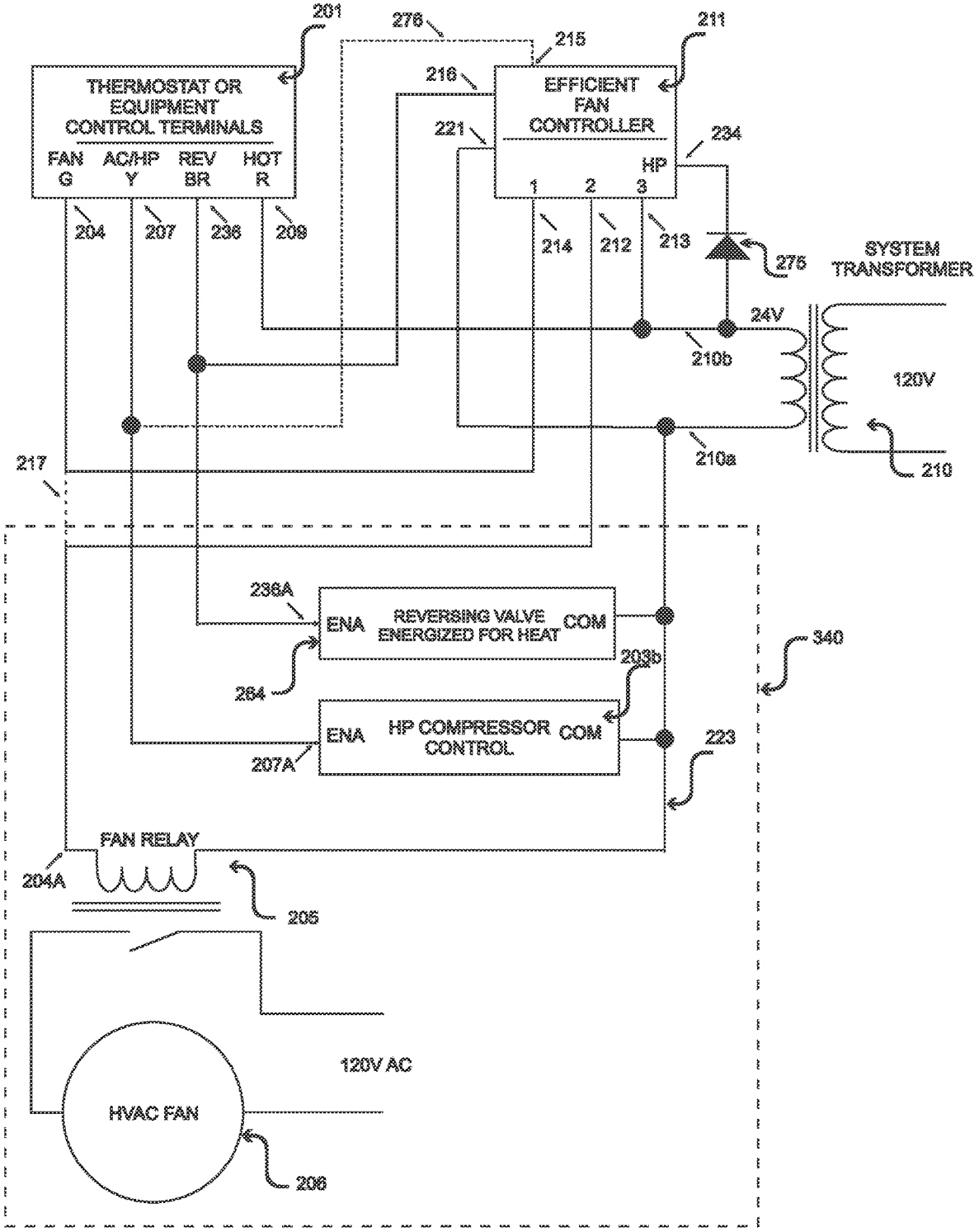
FIG. 3 shows the efficient fan controller connected to a heat pump HVAC system with reversing valve energized for heating.

FIG. 3 shows the efficient fan controller 211 connected to an HVAC system with the HP compressor control 203*b* for DX cooling and heating and a heat pump reversing valve 264 energized for heating. The HVAC system 340 is shown as a dashed line with the reversing valve 264 energized for heating, the HP compressor control 203*b*, the fan relay 205, and the HVAC fan 206. The efficient fan controller 211 is connected to the thermostat or equipment control terminals 201 which transmit active or inactive 24 VAC analog signals to the efficient fan controller (211) inputs: 1) the fan G terminal 204 is connected to the input 204A of the fan relay 205 or to the fan G input 214, 2) the AC/HP Y terminal 207 is connected to the input 207A of the HP compressor control 203*b* or to the AC/HP Y input 215 using an optional wire 276, 3) the REV BR terminal 236 (reversing valve) is connected to the input 236A of the reversing valve 264 or to the heat W input 216, 4) the common terminal 210*a* from the system transformer 210 is connected to the COM B input 221 and also connects using the wire 223 to the reversing valve 264 and the HP compressor control 203*b* and the fan relay 205, and 5) the hot R terminal 209 is connected to the hot R input 213 The hot R terminal may also be connected to efficient fan controller 211 through the HP input 234 with a diode 275 to detect a HP with a reversing valve 264 energized for heating. The diode 275 only allows current to flow to the efficient fan controller 211 on positive cycles of the hot R signal from the system transformer 210. By detecting current flowing only during the positive cycle and not on the negative cycle, the efficient fan controller 211 provides control for a HP system with the reversing valve 264 energized for heating. The dashed line 217 indicates where the original thermostat fan signal wire to the fan relay 205 has been disconnected in order to route this signal to the fan G input 214. The efficient fan controller transmits an active 24 VAC analog control signal through the fan signal output 212 to control the fan relay 205 and the HVAC fan 206.

Figure 4:
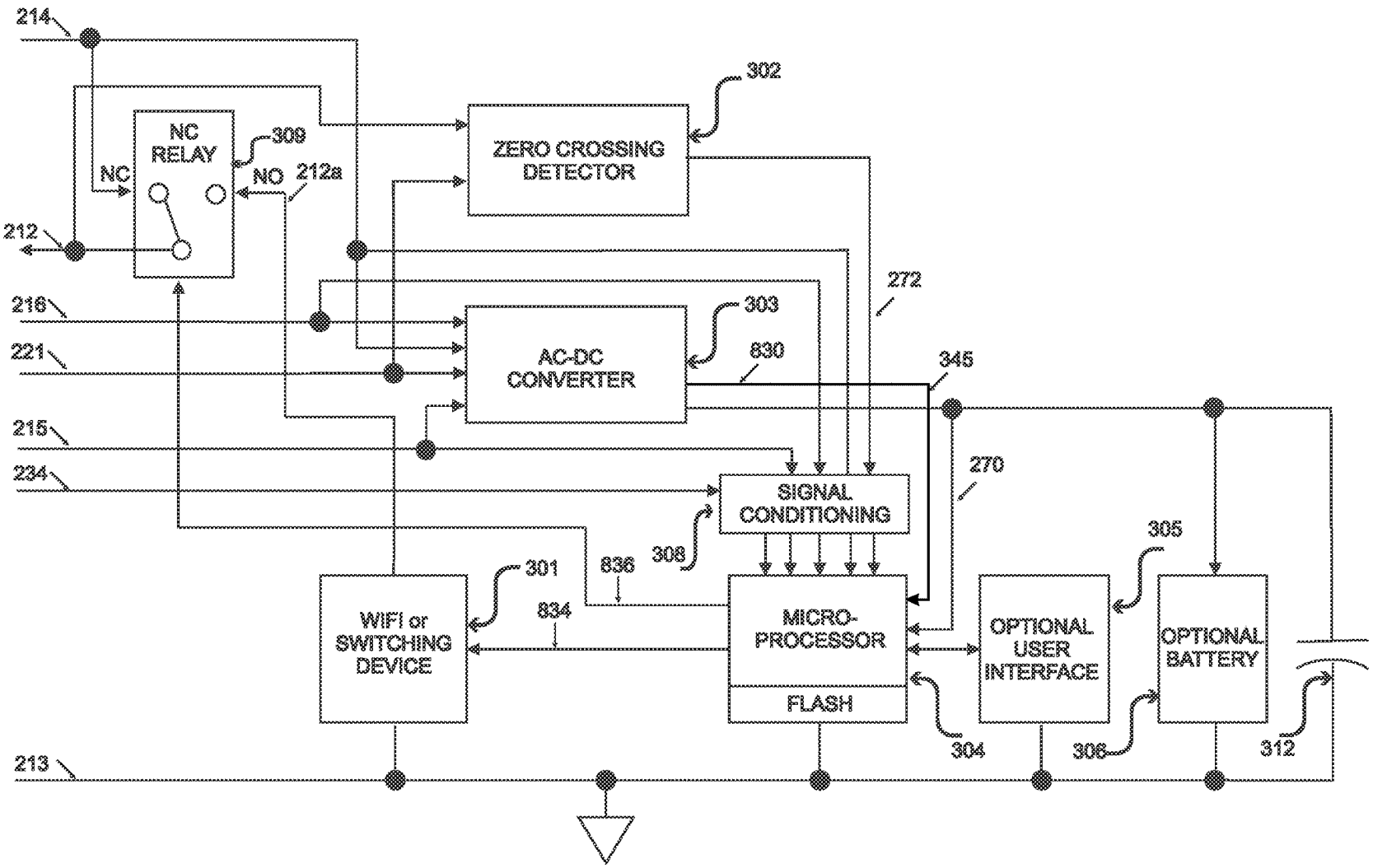
FIG. 4 shows elements of the efficient fan controller for HVAC systems with direct-expansion Air Conditioning (AC) and gas furnace, heat pump, electric resistance, or hydronic heating.

FIG. 4 shows components of the efficient fan controller 211 used to control HVAC systems with DX cooling and gas furnace, electric resistance, heat pump, or hydronic heating. A Normally Closed (NC) relay or the NC relay 309 connects the active or inactive 24 VAC analog signal from the thermostat to the fan signal output 212 of the efficient fan controller 211. The NC relay 309 in the efficient fan controller 211 provides a fail-safe option for the fan G terminal 204 to always be connected to the fan relay 205 and allow the HVAC fan 206 to properly operate. Under normal operation, when the efficient fan controller 211 is controlling the fan relay 205, the microprocessor 304 provides a signal 836 to the NC relay 309 to be in a Normally Open (NO) position. When the efficient fan controller 211 receives a fan signal on the fan G input 214, the microprocessor 304 provides a fan control output signal 834 which is a non-zero Volts Direct Current (VDC) digital signal to a WIFI or switching device 301 which provides an analog fan control signal 212*a* to the NC relay 309 to energize the fan relay 205 and control the HVAC fan 206. The WIFI or switching device 301 may be used to send and/or receive a wired signal or a wireless signal to the fan relay or any other HVAC system device using a smart communicating thermostat with temperature sensors and WIFI technology for wireless local area networking based on the IEEE 802.11. The efficient fan controller 211 has the following 24 VAC analog signal inputs from the thermostat or equipment control terminals 201: 1) the fan G input 214, 2) the AC/HP Y input 215, 3) the heat W input 216, and 4) the HP input 234. The fan signal output 212 of the efficient fan controller 211 is used to energize the fan relay 205 and operate the HVAC fan 206. The input signals including the fan G input 214, the AC/HP Y input 215, the heat W input 216, and the HP input 234 and an output of the zero crossing detector 302 pass through a signal conditioning element 308 to provide a zero VDC digital signal or a non-zero VDC digital signal to the microprocessor 304. The signal conditioning element 308 converts active analog HVAC control signals to zero VDC digital HVAC control signals and converts inactive analog HVAC control signals to non-zero VDC digital HVAC control signals. The microprocessor 304 is used to control the WIFI or switching device 301 and the NC relay 309. The microprocessor 304 also has an input from a zero crossing detector 302. The zero crossing detector 302 monitors a COM B input 221 signal (see FIGS. 1-3) of the system transformer 210. The COM B input may be switched with a Hot R 210*b* input using simple electrical circuit modifications. The zero crossing detector 302 provides an analog zero crossing signal 272 to the signal conditioning element 308 which provides a zero VDC or a non-zero VDC digital to the microprocessor 304 which enables the microprocessor 304 to determine when the hot R input 213 from the system transformer passes above zero volts and below zero volts. This information is used by the microprocessor 304 to count cycles for timekeeping and to determine when to provide the fan control output signal 834. The zero crossing times are also required when the WIFI or switching device 301 is a triac. To operate the triac as a switch, the triac must be fired at all zero crossing transitions. The AC-DC converter 303 has inputs from the system transformer to the COM B input 221 and at least one 24 VAC analog signal selected from the group consisting of: an active heating signal or an inactive heating signal (or gas heating signal) from the thermostat to a heat W input 216, an active AC/HP compressor signal or an inactive AC/HP compressor signal from the thermostat to a AC/HP Y input 215, and an active fan signal or an inactive fan signal from the thermostat to a fan G input 214. Any of these signals can be rectified in the AC-DC converter 303 to provide Direct Current (DC) power to the microprocessor 304 and to keep an optional battery 306 charged. An optional super capacitor 312 can be charged from the AC-DC converter 303 and used to power the fan controller until sufficient voltage can be generated from the input signals. A DC rail voltage signal 270 from the AC-DC converter 303 or the optional battery 306 may be used to power the microprocessor and charge the optional super capacitor 312. There is also an optional user interface 305 which may be used to configure the microprocessor 304 to perform in an alternate manner. A HP input 234 to detect a Heat Pump (HP) is passed through the signal conditioning element 308 before being passed to the microprocessor 304. The zero crossing detector 302 processes the fan signal output 212 and the COM B input 221 and passes these signals to the signal conditioning element 308 which provides a zero VDC or a non-zero VDC digital for the microprocessor 304 to detect when the thermostat signals are above ground and below ground. If the HP input 234 is not connected to the system transformer 210 as shown in FIG. 1, then the microprocessor 304 detects the signal to the HP input 234 as floating and detects it is not connected to a HP system. If the HP input 234 is connected to the system transformer 210 as shown in FIG. 2, the microprocessor 304 detects the HP signal driven above and below ground and the microprocessor 304 detects it is connected to a HP system with the reversing valve energized for cooling.

When a diode 275 is introduced as shown in FIG. 3, the signal to the HP input 234 is driven during the positive cycle and floats because of the direction of the diode 275, during the negative cycle where the signal is rectified. The microprocessor 304 detects this state and performs like it is connected to a heat pump system with a HP reversing valve (the reversing valve 263 energized for cooling or the reversing valve 264 energized for heating) driven for heating. As discussed above, the microprocessor 304 is configured to detect whether or not a specific signal input is active or inactive based on input signals received from the signal conditioning element 308 which is able to process five low-voltage electrical input signal states: 1) a ground or zero VAC signal, 2) a 24 VAC signal, 3) a floating signal, 4) a false positive stray voltage signal, and 5) rectified signal. The signal conditioning element 308 converts active analog HVAC control signal inputs from the thermostat to zero Volts Direct Current (VDC) digital HVAC control signals, and converts inactive analog HVAC control signals to non-zero VDC digital HVAC control signals used by the microprocessor 304.

The microprocessor 304 performs several functions. In terms of timing, the microprocessor 304 keeps track of seconds and minutes by either monitoring the synchronous zero to +5 VAC 60 Hz square wave output from the AC-DC converter 303 referred to as the signal 345 which is a fifth digital timing HVAC control signal on the wire connection 830 to the microprocessor 304, or by counting microprocessor clock cycles. Each positive zero edge accounts for 1/60th of a second; therefore, sixty positive crossings occur each second. The seconds are then accumulated to keep track of minutes. The negative crossings are also monitored to provide timing for the WIFI or switching device 301.

The efficient fan controller 211 draws power from the system transformer 210 (see FIG. 1-3). The switching device 301 can be standard relay type device, a reed relay or some other electro-mechanical device, and can also be a solid-state device such as an FET switch or a triac. In the event that an electro-mechanical switch is used, either an optional battery can be added to power the microprocessor 304 or the AC/HP Y input 215, the heat W input 216 or the COM B input 221 can provide power through the AC-DC converter when the switch is closed. The fan controller uses the Hot R 210*b* signal from the system transformer 210 and a triac to substitute for the WIFI or switching device 301 and does not require a battery.

The microprocessor 304 continuously monitors inputs to determine if there is any change to the current system operation. The microprocessor 304 contains FLASH memory, which allows the unit to store the programming instructions and data when there is no power applied to the unit. The microprocessor 304 monitors the duration of the active or inactive signals from the thermostat or equipment control terminals 201 including: 1) the fan G input 214, 2) the AC/HP Y input 215, and/or 3) the heat W input 216. The microprocessor 304 adjusts the variable fan-off delay P2 based on the active or inactive analog signals representing the cooling cycle duration or the heating cycle duration including at least one cycle selected from the group consisting of: an on cycle and an off cycle. If the AC compressor or the heat source are operated for a short period of time (i.e., short cycle) and there is not much condensation stored on the evaporator or heat stored in the heat exchanger, then the fan relay 205 and the HVAC fan 206 operating time will be extended for a shorter period of time or not. Likewise, if the AC compressor operates longer allowing more condensate to be stored on the evaporator, or the heat source control 202 operates longer storing more heat in the heat exchanger, then the efficient fan controller 211 will energize the fan relay 205 and operate the HVAC fan 206 to run for a longer fan-off delay period of time after the AC compressor or the heat source have stopped.

Figure 5:
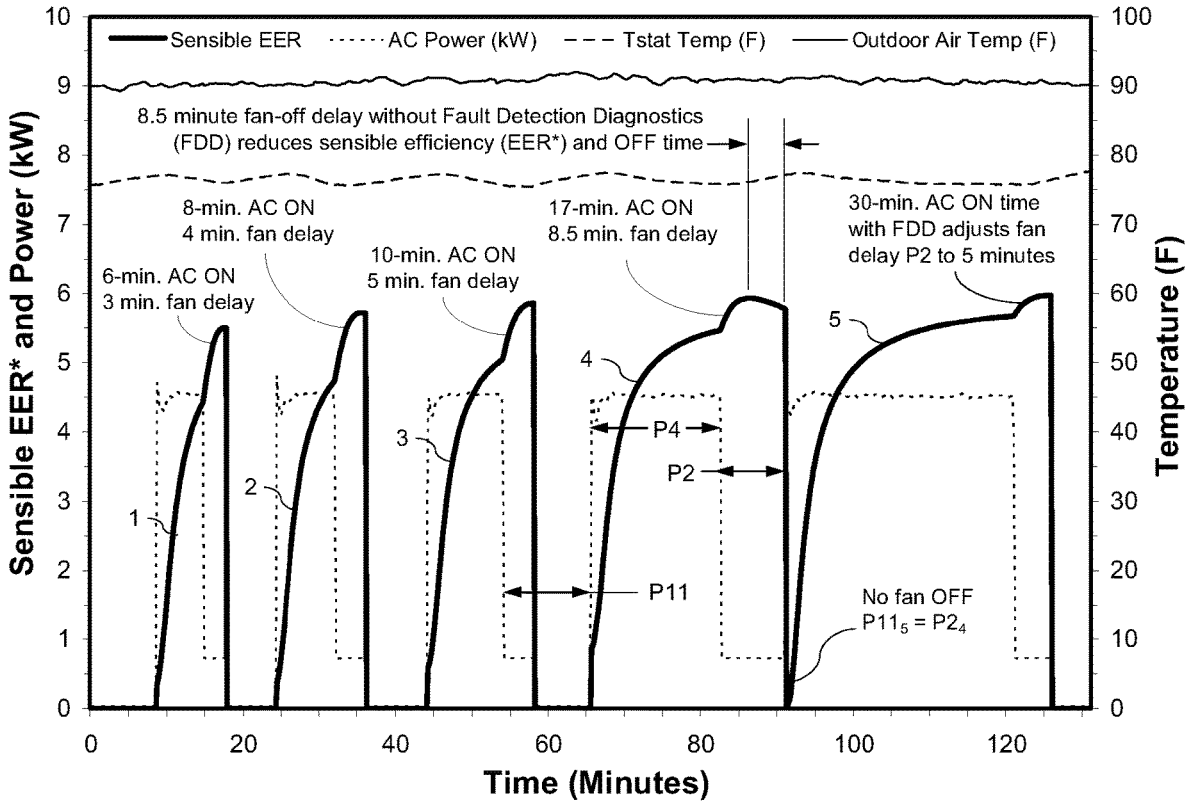
FIG. 5 shows the efficient fan controller with and without a method providing variable fan-off delays and identifying low sensible cooling capacity and correcting the final variable fan-off delay to improve sensible cooling efficiency.

FIG. 5 shows a graph of a the sensible Energy Efficiency Ratio* (EER*) performance of an HVAC system in cooling mode with a method to improve energy efficiency and conserve energy. The method provides increasing sensible efficiencies from 5.5 to 5.9 EER* based on variable fan-off delays increasing from 3 to 5 minutes for AC compressor cycles 1-3 with durations of six to 10 minutes. During a 17-minute AC compressor cycle 4 with 8.5 minute fan-off delay, the sensible efficiency drops to 5.7 EER* due to continued fan operation with insufficient moisture on the evaporator coil. AC compressor cycle 5 turns on during the cycle 4 fan-off delay period P2 when the thermostat temperature exceeds 77 degrees Fahrenheit (° F.), which is the upper differential based on a 76° F. cooling setpoint resulting in no time between cycle 4 and cycle 5 where the fan and the AC compressor are both off (i.e., P115=P24). Furthermore, Cycle 5 turning on during the cycle 4 fan-off delay indicates insufficient evaporative cooling available to support the cycle 4 fan-off delay of 8.5 minutes. The method detects the AC compressor turning on during the cycle 4 fan-off delay and stores this FDD information. After the fifth 30-minute AC compressor cycle 5 the FDD method automatically reduces the cycle 5 fan-off delay to 5 minutes to increase the AC compressor Off time and increase the sensible efficiency to 6 EER* which is a 5% improvement compared to 5.7 EER* for cycle 4 that had no AC compressor Off time.

Figure 6:
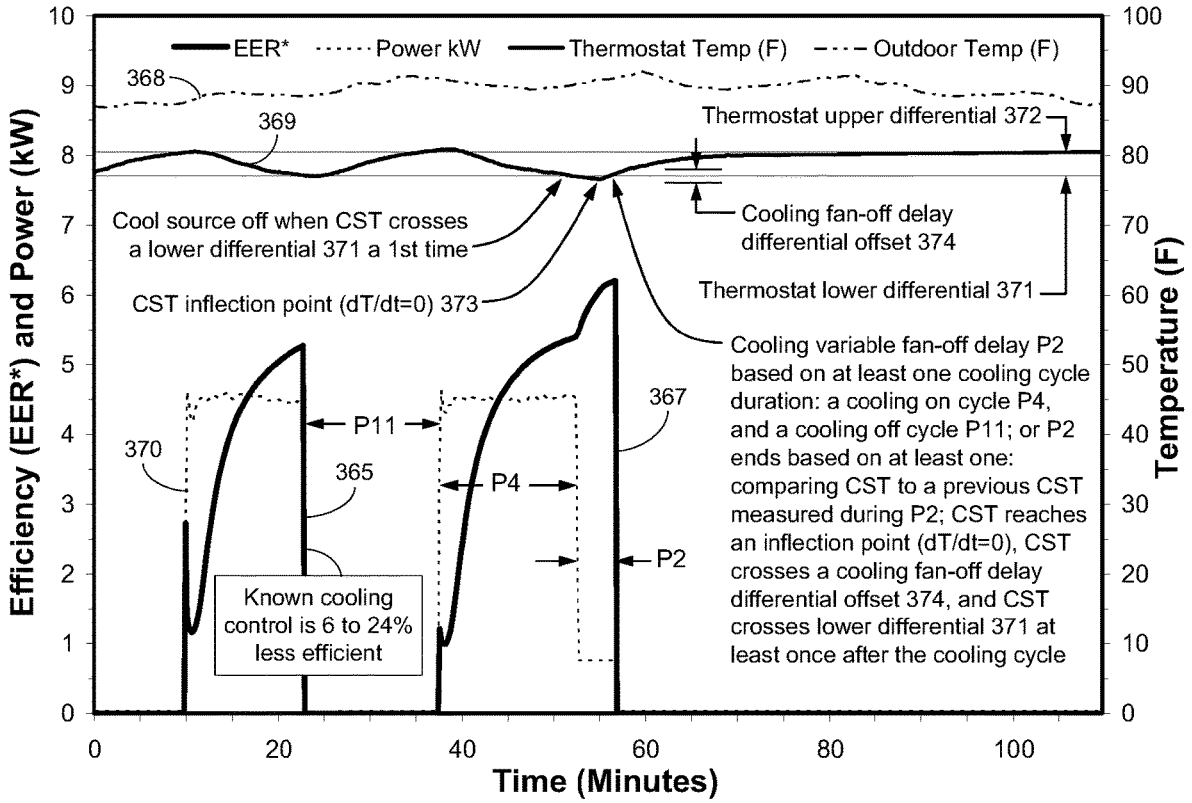
FIG. 6 shows a graph of the sensible cooling Energy Efficiency Ratio (EER*), cooling system power, outdoor air temperature, thermostat temperature, and rate of change of thermostat temperature with respect to time (dT/dt) for a direct-expansion cooling system with known control and the variable fan-off delay control method.

In another embodiment, the FDD algorithm determines a variable fan-off delay P2 based on the cooling cycle duration P4 including at least one cycle selected from the group consisting of: a cooling on cycle, and a cooling off cycle P11, or optionally, the Conditioned Space Temperature (CST) as measured by the thermostat (see FIG. 6).

Figure 7:
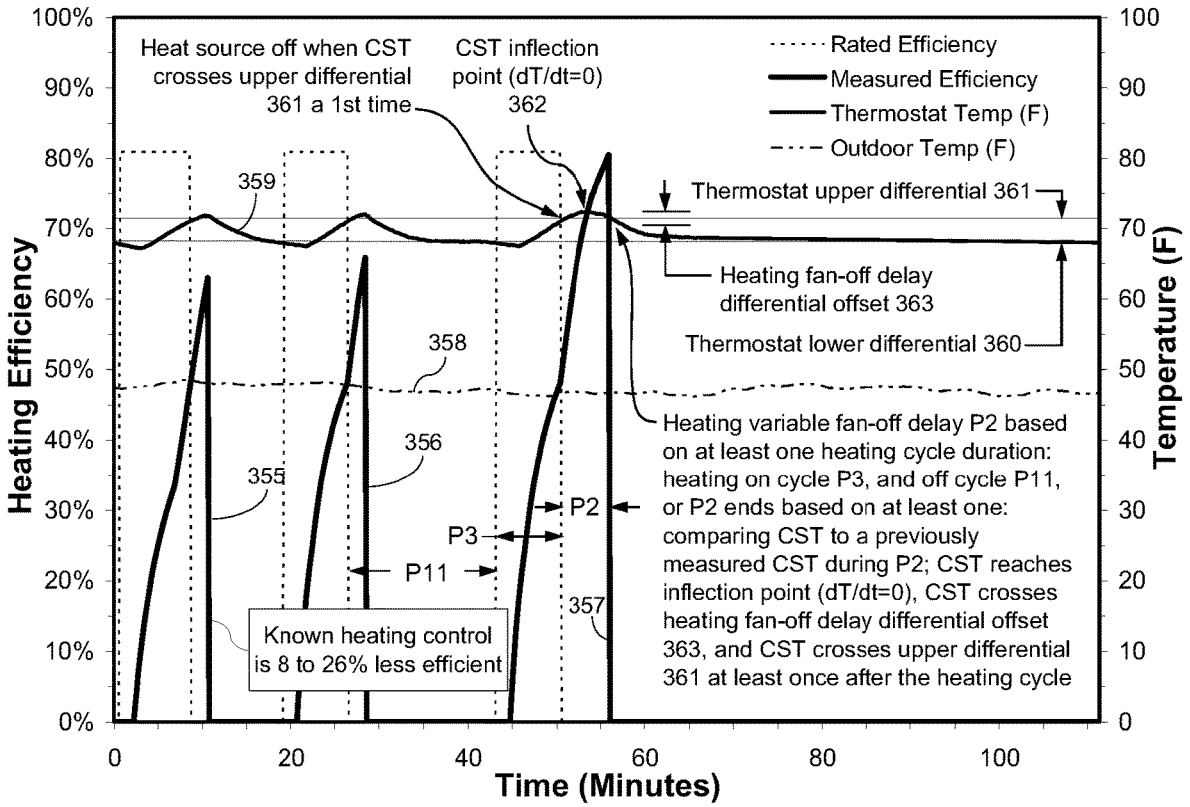
FIG. 7 shows a graph of heating efficiency, outdoor air temperature, indoor thermostat temperature, and rate of change of indoor thermostat temperature versus time of operation for a gas furnace heating system with a known control and the variable fan-off delay control method.

In another embodiment, the FDD method determines a variable fan-off delay P2 based on the heating cycle duration P3 including at least one cycle selected from the group consisting of: a heating on cycle, and a heating off cycle P11, or optionally, the CST as measured by the thermostat (see FIG. 7).

For both of these embodiments, the variable fan-off delay P2 is based on the heating cycle duration P3 or the cooling cycle duration P4 in order to extend the fan-on operating time to improve energy efficiency. The off cycle time P11 is used to adjust the variable fan-off delay P2 to extend the off cycle time P11 and improve energy efficiency. If the variable fan-off delay P2 causes the off cycle time P11 to be less than the heating cycle duration P3 or the cooling cycle duration P4 indicating low heating or cooling capacity due to system faults or severe weather, then the P11 and the P3 or the P4 are used to reduce the P2. If the variable fan-off delay P2 causes the off cycle time P11 to increase relative to the P3 or the P4, then the P11 and the P3 or the P4 are used to increase the P2.

The method monitors the cooling or heating off cycle time P11 and adjusts P2 based on P11 where P2 is adjusted up if P11 is increasing and P2 is adjusted down if P11 is decreasing. The adjustment is determined based on how far P11 is from P4 over time. If the rate of change of P11 with respect to time is decreasing, then the method reduces P2, and if the rate of change of P11 with respect to time is increasing, then the method increases P2. The method increases thermal comfort, extends off cycle times, reduces on cycle times, improves efficiency, and saves energy.

FIG. 6 shows a graph of the sensible cooling application Energy Efficiency Ratio (EER*) 365, electric power 370, outdoor air temperature 368, thermostat temperature 369, and EER* for a HVAC system in cooling mode. FIG. 6 shows a first EER* curve 365 going from 0 to 5.3 EER* with no fan-off delay. The AC compressor and the fan are turned on when the thermostat temperature or the CST is at the upper cooling differential 372, and the AC compressor and fan are turned off when the thermostat temperature decreases to the lower cooling differential 371 a first time. FIG. 6 shows a second EER* curve 367 going from 0 to 6.2 EER* with a variable fan-off delay P2 of 4.33 minutes. The variable fan-off delay P2 may be based on a cooling cycle duration P4 including at least one cycle selected from the group consisting of: a cooling on cycle, and a cooling off cycle P11. A rate of change of the thermostat temperature with respect to time (dT/dt) is shown as the slope of the thermostat temperature 369.

In another embodiment the thermostat cooling variable fan-off delay P2 is ended based on comparing a temperature measurement of a Conditioned Space Temperature (CST) to a CST threshold wherein the CST threshold is based on a previous measurement of the CST monitored during the current variable fan-off delay. The variable fan-off delay P2 is ended based on the CST as measured by the thermostat temperature 369 reaching at least one measurement threshold selected from the group consisting of: a measurement of the CST decreases to a minimum thermostat temperature after the cool source is turned off where the rate of change of temperature with respect to time (dT/dt) reaches an inflection point and is approximately equal to zero (dT/dt=0) plus or minus a confidence interval tolerance, the measurement of the CST increases to a cooling fan-off delay differential offset 374, and the measurement of the CST crosses a lower cooling differential 371 at least once after the cooling cycle.

Operating individually or together, these FDD fan-off delay embodiments can be used to detect faults impacting energy efficiency performance, and recover and deliver additional sensible cooling energy from a cool source to improve efficiency and thermal comfort and reduce cooling system operating time to save energy.

FIG. 7 shows a graph of a heating efficiency, an outdoor air temperature 358, and a thermostat temperature 359. The heating efficiency curve 355 reaches 63% and the heating efficiency curve 356 reaches 66% for the known control. The heat source is turned on when the CST or thermostat temperature decreases to the lower heating differential 360, the heat source is turned off when the thermostat temperature reaches the upper heating differential 361 a first time, and the fan operates for a fixed fan-off delay after the heat source is turned off. A measured rate of change of the CST or the thermostat temperature 359 versus time of operation is illustrated by the slope of the CST or the thermostat temperature 359.

FIG. 7 also shows a heating efficiency curve 357 reaches 80.5% representing a heating system operating until the measurement of the CST reaches the upper heating differential 361 a first time where the heat source is turned off and the HVAC fan continues to operate for a variable fan-off delay time P2 based on the heating cycle duration P3 including at least one cycle selected from the group consisting of: a heating on cycle, and a heating off cycle P11.

In another embodiment the heating variable fan-off delay P2 is optionally based on the CST as measured by the thermostat temperature 359 reaching at least one threshold selected from the group consisting of: the measurement of the CST reaches a maximum temperature beyond the upper heating differential 361 after the heat source is turned off where the rate of change of the temperature with respect to time (dT/dt) reaches an inflection point and is approximately equal to zero (dT/dt=0) plus or minus a confidence interval tolerance, the measurement of the CST decreases to heating fan-off delay differential offset 363, and the measurement of the CST crosses the upper heating differential 361 at least once after the heating cycle.

The CST thresholds for heating and cooling can be adjusted based on at least one duration selected from the group consisting of: the heating cycle duration P3, the cooling cycle duration P4, and the off cycle P11. The method can improve HVAC cooling and heating efficiency by providing a variable thermostat differential to provide longer operating times where the variable differential is based on the heating cycle duration P3, the cooling cycle duration P4, and the off cycle P11.

Operating individually or together, these FDD embodiments can be used to detect faults impacting energy efficiency performance, and recover and deliver additional sensible heating energy from a heat source to improve efficiency and thermal comfort and reduce heat source operational time to save energy.

Figure 8:
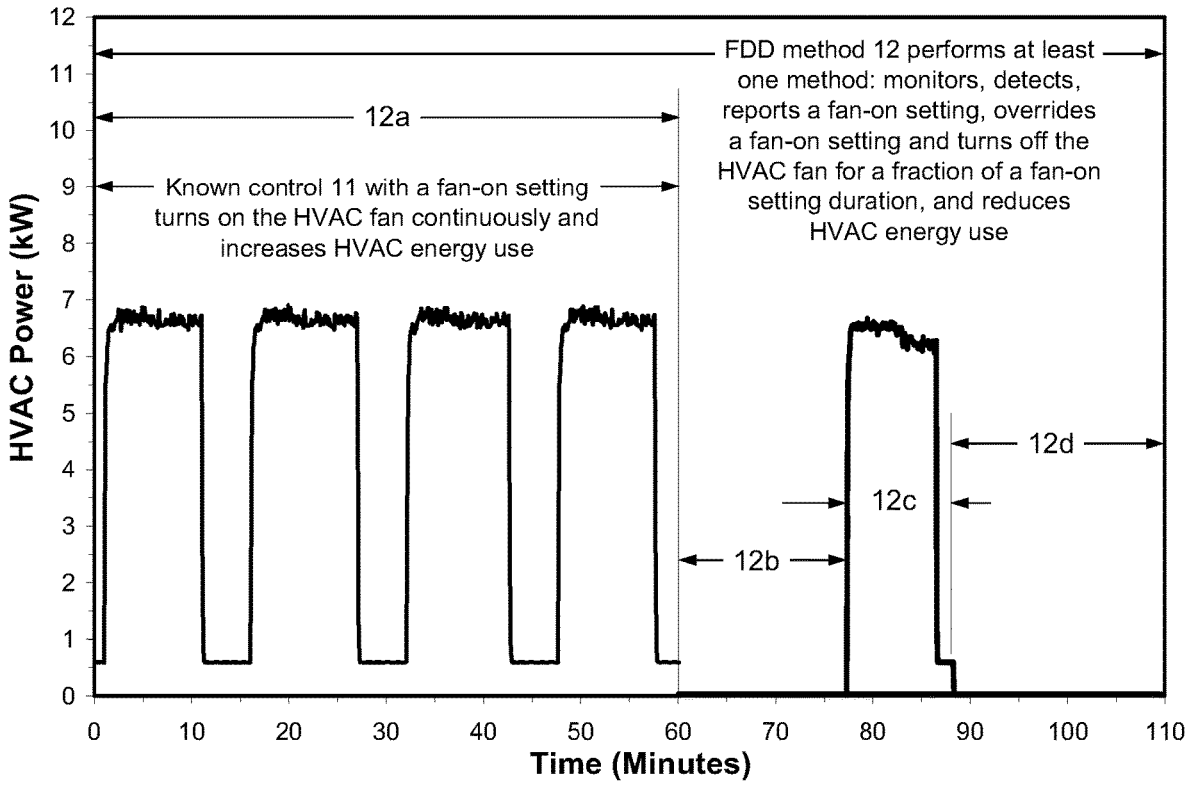
FIG. 8 shows a known control with a fan-on setting providing continuous fan operation for 60 minutes and a FDD method detecting, reporting, and overriding the fan-on setting, turning off the HVAC fan for a fraction of a fan-on setting duration, and turning on the HVAC fan during a thermostat call for cooling or heating or a fan-off delay.

FIG. 8 shows a known control 11 operating from 0 to 60 minutes for a HVAC system with a fan-on setting causing continuous fan power and increasing HVAC energy use. FIG. 8 also shows the FDD method 12 operating from 0 to 110 minutes where the FDD method detects a fan-on setting or monitors active or inactive signals present on a thermostat or equipment control terminals to determine if the HVAC thermostat fan control has been set to the fan-on setting. FIG. 8 shows the FDD method 12 performs at least one method: monitors, detects, reports a fan-on setting, overrides a fan-on setting and turns off the HVAC fan for a fraction of a fan-on setting duration, and reduces HVAC energy use. FIG. 8 shows the FDD method allows the fan-on setting and four HVAC cycles for a first time duration 12*a* of 60 minutes. FIG. 8 shows the FDD method overrides the fan-on setting and turns off the HVAC fan for a second time duration 12*b* of 17.3 minutes from 60 minutes to 77.3 minutes or 15.7% of the fan-on setting duration of 110 minutes. The FDD method allows a HVAC cycle and a fan-off delay for a third time duration 12*c* of 12.3 minutes from 77.3 minutes to 88 minutes. The FDD method overrides the fan-on setting and turns off the HVAC fan for a fourth time duration 12*d* of 22 minutes from 88 minutes to 110 minutes or 20% of the fan-on setting duration of 110 minutes. The FDD method may also include an optional user interface 305 (shown in FIG. 4) which may be used to configure the microprocessor 304 to enter a user-selected TFT value. The fan-on setting may comprise at least one fan-on setting selected from the group consisting of: a continuous hourly fan-on setting greater than 0 minutes to 60 minutes, a continuous daily fan-on setting of 1 hour to 24 hours, and a continuous fan-on setting greater than 24 hours (on a scheduled basis). The FDD method detects at least one fan-on setting selected from the group consisting of: an active fan signal with neither an active cooling signal nor an active heating signal from the thermostat, the active fan signal and an inactive heating signal from the thermostat, the active fan signal and an inactive AC/HP compressor signal from the thermostat, the active fan signal without an active fan-off delay signal after the active cooling signal or after the active heating signal from the thermostat, or the active fan signal and an active gas heating signal from the thermostat or equipment terminal or the presence of the fan-on setting without a thermostat call for cooling or without a thermostat call for heating. By turning off the fan-on setting during the occupied or the unoccupied period the FDD method reduces over ventilation and HVAC energy by 10 to 90%.

Figure 9:
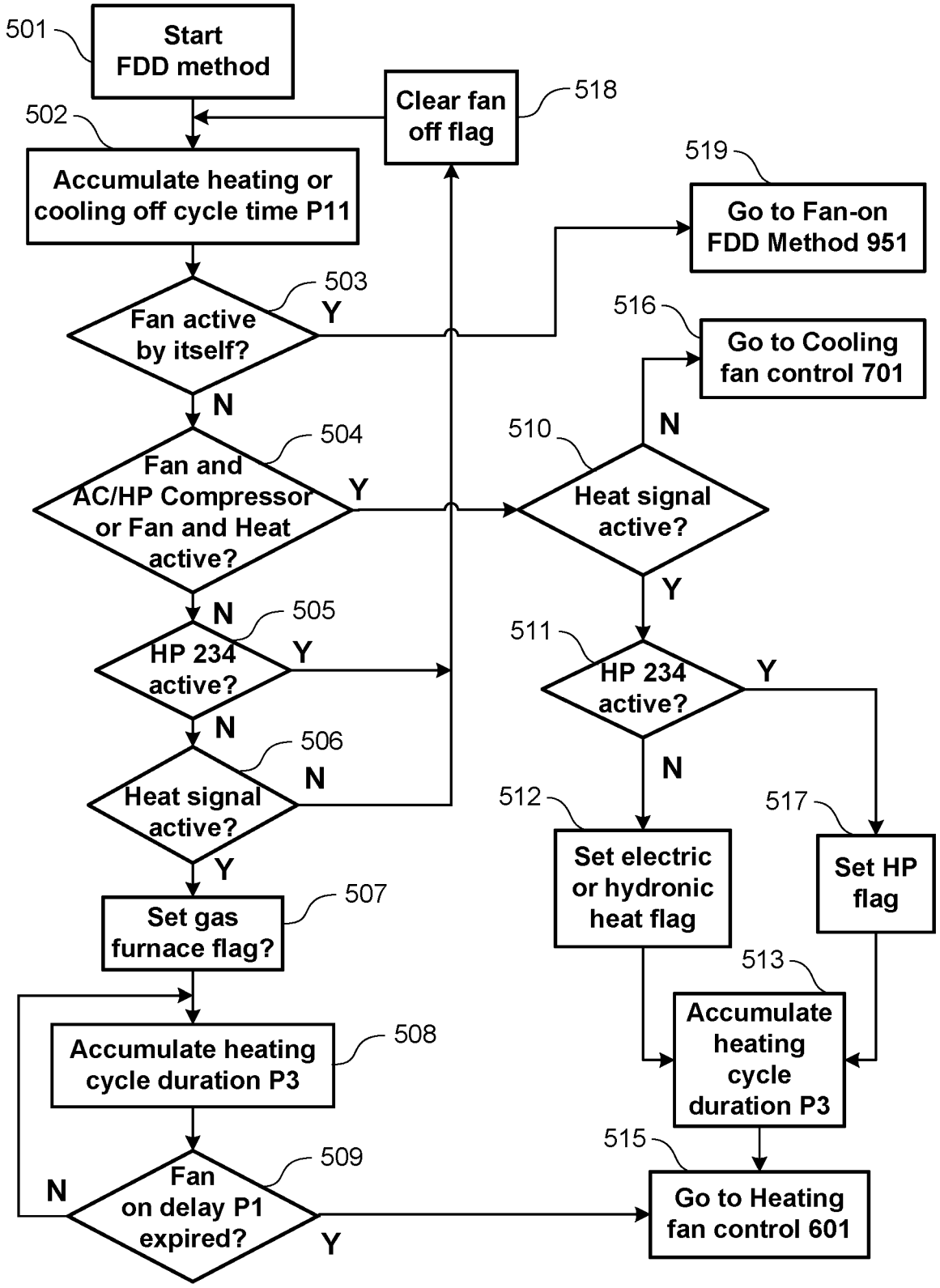
FIG. 9 shows a first method for determining what type of HVAC system is connected and what fan controller operating mode and what aspect of the FDD method to perform.

FIG. 9 provides a flowchart of the FDD method to determine an HVAC system type and operating mode and fan control including detecting a fan-on setting and provide a variable fan-off delay. The FIG. 9 flowchart starts at the FDD method step 501. Step 502 accumulates the heating off cycle duration or the cooling off cycle duration P11. The FDD method uses the off cycle duration P11 to decrease the variable fan-off delay P2, if P11 is less than the heating on cycle (P3-P11) or the cooling on cycle (P4-P11) minus a tolerance based on a third coefficient times the heating on cycle duration (P3-P11) or a first coefficient times the cooling on cycle duration (P4-P11) where the third coefficient varies as a function of the heating on cycle duration (P3-P11) and the first coefficient varies as a function of the cooling on cycle duration (P4-P11).

The FDD method also uses the off cycle duration P11 to increase the variable fan-off delay P2, if P11 is greater than the heating on cycle (P3-P11) or the cooling on cycle (P4-P11) plus a tolerance based on a fourth coefficient times the heating on cycle (P3-P11) or a second coefficient times the cooling on cycle (P4-P11) where the fourth coefficient varies as a function of the heating on cycle (P3-P11) and the second coefficient varies as a function of the cooling on cycle (P4-P11). If P11 is within a range of P3+/−the tolerance (defined by the first and second coefficients), then the FDD method does not adjust P2 which is based on the heating cycle duration P3 or the cooling cycle duration P4. For the gas furnace, the FDD method provides a fan-on delay P1 before the fan is energized to a ventilation fan speed higher than a lower heating ventilation fan speed normally used for heating when a fan relay is energized after a short delay to allow the heat exchanger (HX) to reach operating temperature.

Figure 10:
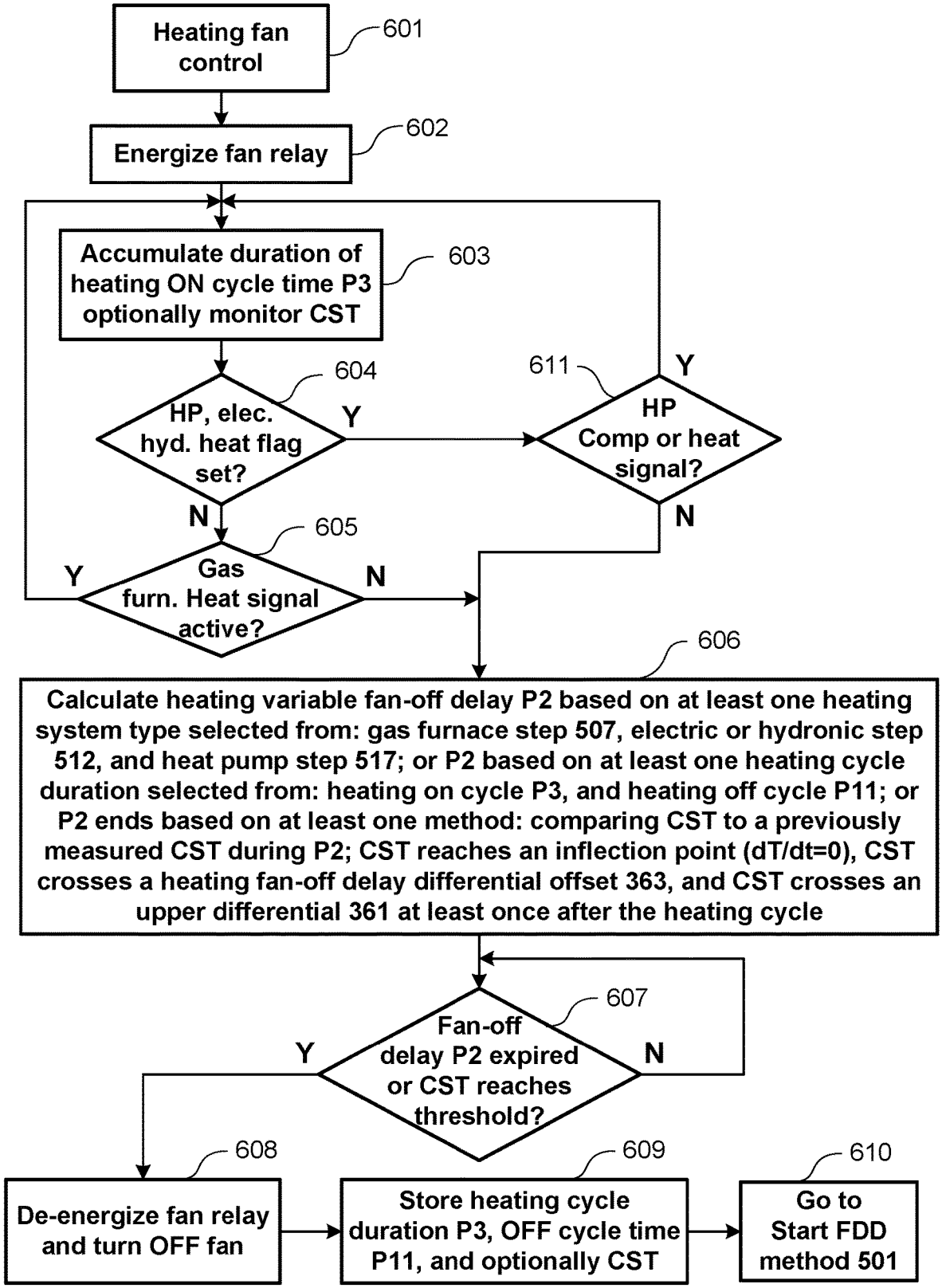
FIG. 10 shows a method for determining a variable fan-off delay P2 after a heating cycle.
Figure 11:
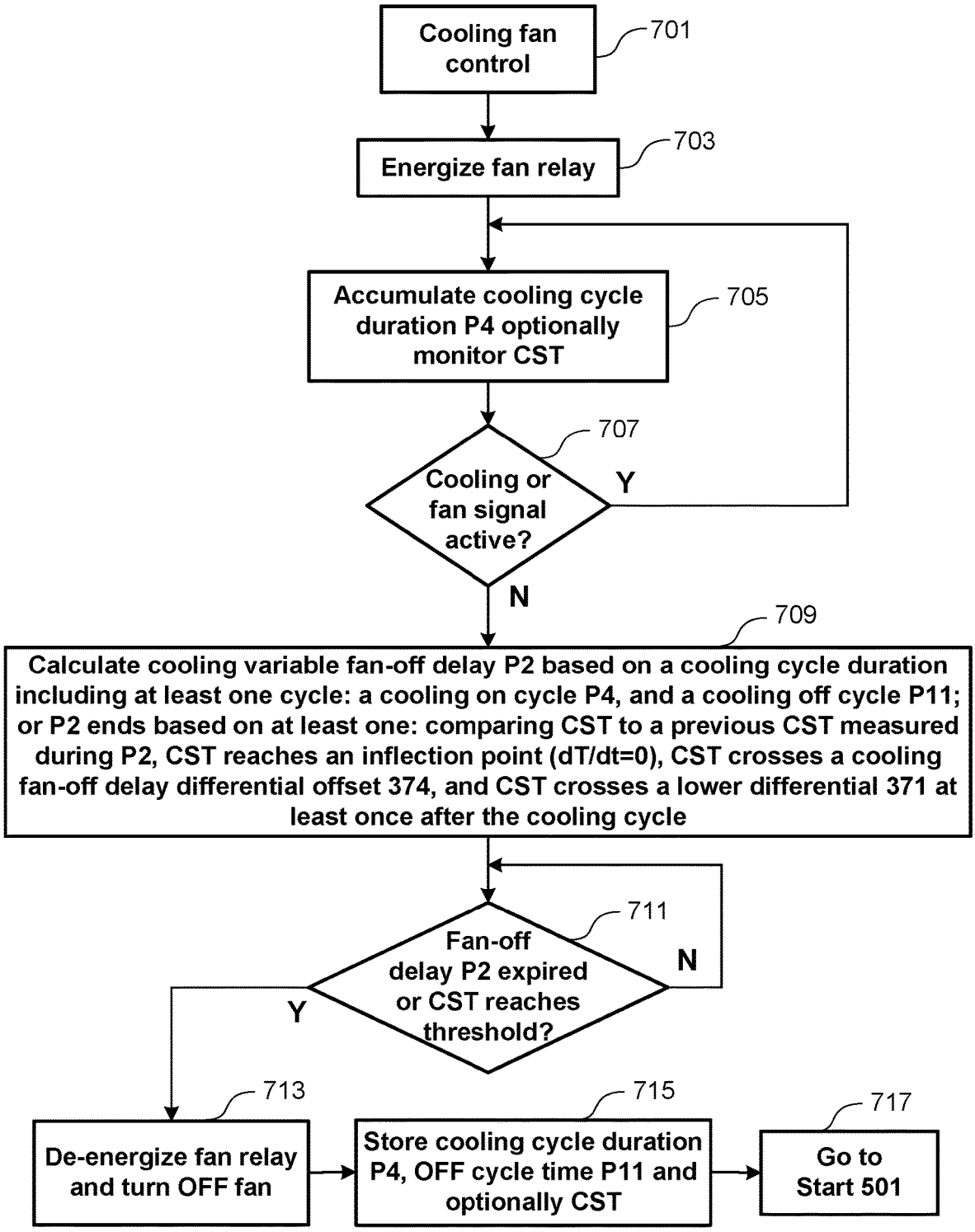
FIG. 11 shows a method for determining a variable fan-off delay P2 after a cooling cycle.
Figure 12:
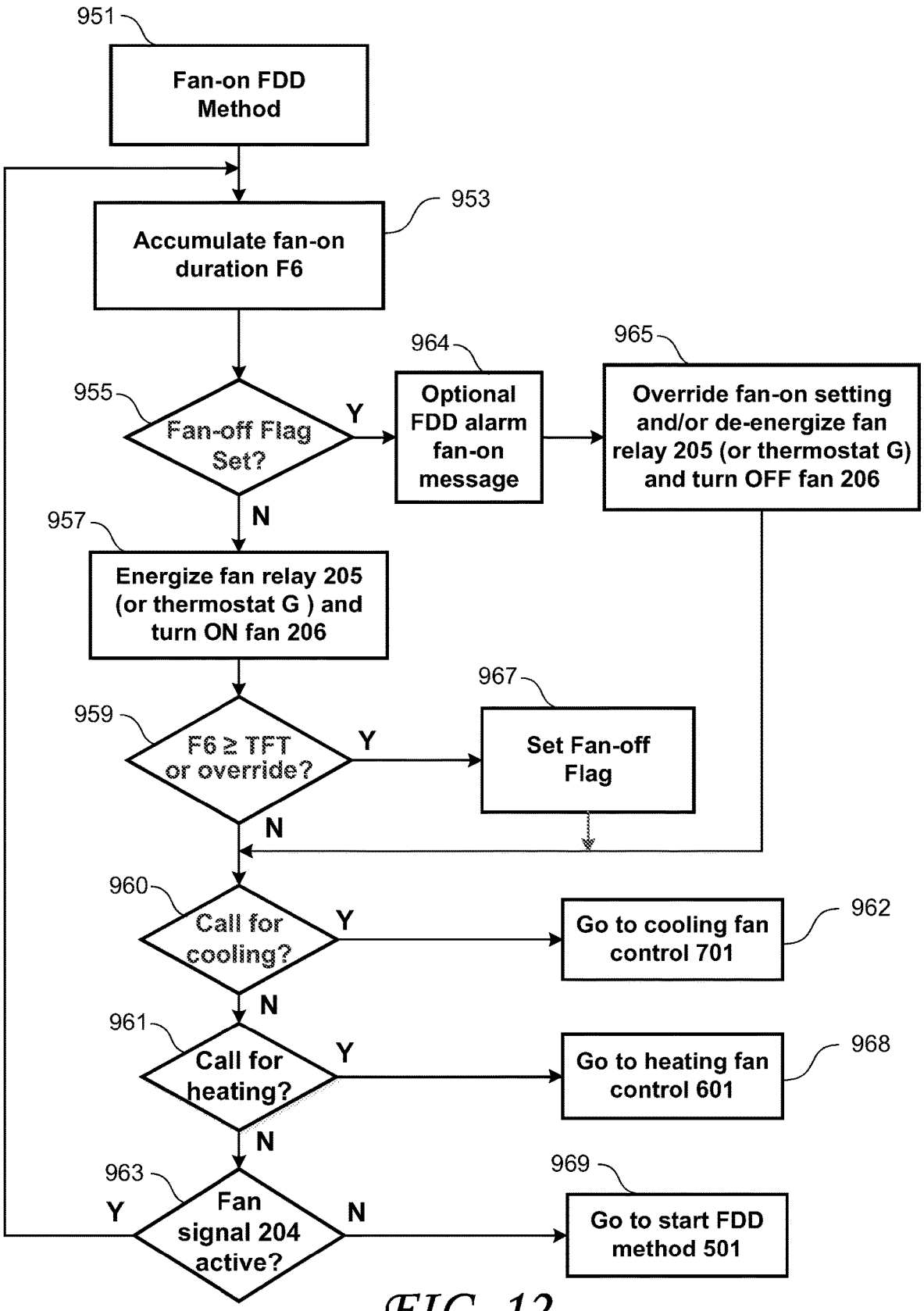
FIG. 12 provides a flow chart of a fan-on FDD method to diagnose and optionally report a fan-on setting without a thermostat call for cooling or heating in order to override and turn off the fan to save fan energy and cooling or heating energy.

FIG. 9 at step 503 detects whether or not a fan is active by itself and operating continuously without a thermostat call for heating or cooling. If step 503 is Yes (Y), then the method proceeds to step 519 Go to Fan-On FDD method the step 951 (FIG. 12). In FIG. 12, the FDD method diagnoses the fan-on setting, and determines whether or not to provide an optional FDD alarm fan-on message, override the fan-on setting, and de-energize the fan relay (or thermostat fan G signal) and turn off the HVAC fan to save energy. For a thermostat controlling a gas furnace, the heat W signal is energized without the fan G signal during the heating cycle, and for a thermostat fan-off delay the method proceeds to the step 515 Go to the heating fan control step 601 (FIG. 10). For a thermostat controlling a heat pump, electric resistance, or hydronic heating system, the method proceeds to step 515 Go to the heating fan control step 601 (FIG. 10). For a thermostat controlling a cooling system, the method proceeds to the step 516 and the step 701 cooling fan control (FIG. 11). Otherwise, the FDD method goes to step 504 to determine if the fan and the AC/HP compressor or the fan and the heat are active. If the step 504 is Yes (Y), then the method goes to step 510 to determine if the heat signal is active. If the step 504 is No (N), then the method proceeds to step 516 Go to Cooling fan control the step 701 (FIG. 11).

At step 510, if the heat signal is active simultaneously with the fan signal, then the method proceeds to step 511 to determine which system is active including at least one system selected from the group consisting of: a heat pump heating, an electric heating, or a hydronic heating system. If step 511 determines the HP input 234 signal is active, then the method proceeds to step 517 to set the HP flag. If step 511 determines the HP input 234 signal is not active, then the method proceeds to step 512 to set electric or hydronic heat flag. After steps 512 or 517, the method proceeds to step 513 to accumulate heating on cycle time P3, and proceeds to step 515 Go to the heating fan control step 601 (FIG. 10).

FIG. 9 steps 504 through 508 determine if gas furnace heating is active (with no fan signal). If the step 505 is yes (Y), the HP input 234 signal is active, then the method loops back to step 518 clear fan off flag. If the step 505 is No (N), the HP input 234 signal is not active, then the method proceeds to step 506. If step 506 determines No (N) the heat signal is not active, then the method loops back to step 518 clear fan off flag. If step 506 determines Yes (Y), the heat signal is active, then method proceeds to step 507 to set gas furnace flag, step 508 to accumulate heating cycle P3 and step 509 to evaluate if fan on delay P1 expired and if not, loops back to step 508 to continue to accumulate heating on cycle P3 time. If step 509 determines Yes (Y), fan on delay P1 has expired, then proceeds to step 515 Go to the heating fan control step 601 (FIG. 10). In some embodiments, heat pump operation is established by connecting HP Rev signal to hot side of the system transformer with reversing valve normally energized for cooling or a wire with a diode for a heat pump with reversing valve normally energized for heating.

FIG. 10 shows a heating fan control FDD method. The heating fan control step 601 is the beg inning of the method. Step 602 energizes a switching device which connects 24 VAC to a fan relay to turn on a HVAC fan. Step 603 is the entry of a loop that operates continuously while the thermostat is calling for heating regardless of system type. At step 603, the method accumulates the duration of the heating on cycle P3 and optionally monitors CST until the thermostat is satisfied and discontinues the call for heating. Step 604 is used to determine whether or not a flag is set for HP heating, electric heating, or hydronic heating system based on the step 512 or the step 517 of FIG. 9.

If step 604, determines No (N), the HP, electric, or hydronic heating flag is not set, then the method proceeds to step 605 to determine if the gas furnace heat signal is active (from thermostat W heat terminal), and if Yes (Y), then the method loops back to step 603 to accumulate the heating cycle duration and optionally monitor CST. If the step 605 is No (N), the gas furnace heat signal is not active, then the method proceeds to step 606. At step 606 the method calculates the heating variable fan-off delay P2 based on at least one heating system type selected from the group consisting of: a gas furnace heating system with a flag set in step 507, an electric resistance heating system or a hydronic heating system with the flag set in step 512, and heat pump heating system with the flag set in step 517; or the heating variable fan-off delay P2 is based on at least one heating cycle duration selected from the group consisting of: a heating on cycle duration P3, and a heating off cycle duration P11; or optionally the heating variable fan-off delay P2 is based on the measurement of the CST reaching at least one threshold selected from the group consisting of: the measurement of the CST increases to the maximum thermostat temperature 362 beyond the upper heating differential 361 after the heat source is turned off where the rate of change of the temperature with respect to time (dT/dt) reaches an inflection point and is approximately equal to zero (dT/dt=0) plus or minus a confidence interval tolerance, the measurement of the CST decreases to heating fan-off delay differential offset 363, and the measurement of the CST crosses the upper heating differential 361 at least once after the heating cycle. The variable fan-off delay increases from zero to a maximum and/or decreases to a minimum or zero as a function of the heating cycle duration or the cooling cycle duration or HVAC system type such as a direct-expansion cooling system with at least one heating system type selected from the group consisting of: the gas furnace heating system, the hydronic heating system, the electric resistance heating system, or the heat pump heating system. The heating cycle duration or the cooling cycle duration or the HVAC system type are determined and/or based on thermostat settings and/or measurements of signals present on thermostat or equipment terminals.

Alternatively, if step 604, determines Yes (Y) the heating system is a HP, electric or hydronic heating system then the method proceeds to step 611, and if the HP compressor signal or the heat signal are active Yes (Y), then the method returns to step 603 and accumulates the heating cycle duration P3 and optionally monitors the CST. If step 611 determines No (N), the HP compressor or heat signals are not active, then the method proceeds to step 606. For a thermostat not providing a fan-off delay for a HP, electric or hydronic heating system, the FDD method skips from the step 611 to the step 608 to de-energize the fan relay and turn off the HVAC fan. At step 606 the method calculates the variable fan-off delay P2 or the variable fan-off delay P2 is based on CST (as discussed above). The method uses different algorithms with different coefficients to calculate a unique variable fan-off delay P2 for heat pump heating compared to electric/hydronic heating or gas furnace heating. In step 606, the method calculates the variable fan-off delay P2 for each heating system and each heating cycle duration using the different algorithms with the different coefficients depending on the flag set in the step 507, the step 512, or the step 517. After step 606, the method proceeds to step 607 and continues to loop and operate the HVAC fan 206 for the variable fan-off delay time P2 until the time delay P2 has expired or CST reaches a threshold. At step 607 after the variable fan-off delay time P2 has expired or CST has reached the threshold, the method proceeds to step 608 to de-energize the fan relay and turn Off the fan, step 609 to store heating on cycle P3 and Off cycle P11 and optionally CST, and step 610 Go to start the FDD method step 501 (FIG. 9).

FIG. 11 shows a cooling fan control method. The step 701 is the beginning of the method. The step 703 energizes a switching device which connects 24 VAC to a fan relay to turn on a HVAC fan. Step 705 is the entry of a loop that operates continuously while the thermostat is calling for cooling regardless of system type. At the step 705, the method accumulates the duration of the cooling on cycle P4 and optionally monitors the CST until the thermostat is satisfied and discontinues the call for cooling. If the step 707 determines the cooling or fan signal is active Yes (Y), then the method continues in the loop and accumulates the duration of the cooling on cycle P4.

If step 707 determines No (N), the cooling or fan signal is not active, then the method proceeds to step 709 to calculate the cooling variable fan-off delay P2 based on a cooling cycle duration including at least one cycle selected from the group consisting of: a cooling on cycle P4, and a cooling Off cycle P11. The cooling variable fan-off delay P2 may also be based on a measurement of the Conditioned Space Temperature (CST) reaching at least one threshold selected from the group consisting of: the measurement of the CST decreases to the minimum thermostat temperature 373 beyond the lower cooling differential after the cool source is turned off where the rate of change of temperature with respect to time (dT/dt) reaches an inflection point and is approximately equal to zero plus or minus a confidence interval tolerance, the measurement of the CST increases to cooling fan-off delay differential offset 374, and the measurement of the CST crosses the lower cooling differential 371 at least once after the cooling cycle. In another embodiment, the FDD method compares the cooling off cycle time P11 to the cooling on cycle time P3 in order to determine whether or not to adjust the variable fan-off delay and decrease P2 if P11 is less than the P4 lower tolerance and increase P2 if P11 is greater than the P4 upper tolerance. For a thermostat not providing a fan-off delay, the FDD method skips from the step 707 to the step 713 to de-energize the fan relay and turn off the fan.

After step 709, the method proceeds to step 711 and continues to loop and operate the HVAC fan for the variable fan-off delay time P2 until the variable fan-off delay time P2 has expired or the measurement of the CST reaches the at least one threshold described above. At step 713 after the variable fan-off delay time P2 has expired, the method de-energizes the fan relay and turns off the fan. At step 715 the method stores the cooling cycle duration P4, the off cycle time P11 and optionally stores the CST, and proceeds to step 717. At step 717 the method goes to Start 501 (FIG. 9).

FIG. 12 shows the Fan-on FDD method to monitor for a continuous fan-on setting operation. The FDD method is used to turn off the HVAC fan if a user-selected fan-on setting or a thermostat fan switch is in the fan-on position. The FDD method comprises monitoring a fan-on time and diagnosing the fan-on time is greater than a Threshold Fan-on Time (TFT) where the FDD method performs at least one action selected from the group consisting of: providing an optional FDD alarm fan-on message at step 964, overriding the fan-on setting to save energy, and de-energizing the fan relay to override the thermostat fan-on setting and turning off the HVAC fan at step 965 to save energy. The TFT or the override duration may be at least one value selected from the group consisting of: greater than 0 minutes to 60 minutes for a continuous hourly fan-on setting, 1 hour to 24 hours for a continuous daily fan-on setting, greater than 24 hours for a continuous fan-on setting, a fraction of the fan-on duration, a fraction of the fan-on setting duration, and a user-selected value. The FDD method continues to monitor HVAC system parameters during the off cycle. Step 951 is the start of the FDD Fan-on method with the fan on and no thermostat call for heating or cooling. At Step 953, the FDD method initiates a continuous loop to accumulate a fan-on operating time or a fan-on duration F6.

At Step 955 the method determines whether or not the "Fan off flag set" is Yes (Y) or No (N). If step 955 is Yes (Y), then the FDD method continues to step 964 to provide an optional FDD alarm message reporting a fan-on setting where the optional FDD alarm message is selected from the group consisting of: a software display message, an email message, a text message, or other communication method. The method continues to step 965 to override the fan-on setting, de-energize the fan relay (or thermostat fan G signal), and turn off the fan. At step 965, the FDD method performs at least one method of overriding the fan-on setting selected from the group consisting of: turning off the HVAC fan during an unoccupied period, turning off the HVAC fan for a fraction of a fan-on duration, turning off the HVAC fan for a fraction of the fan-on setting duration, turning off the HVAC fan for 0 to 100% of the fan-on duration, and turning off the HVAC fan for a user-selected fan-off duration that does not interfere with a fan operation during a thermostat call for cooling or heating or a fan-off delay (see FIG. 8). The Fan off flag is set in step 967 based on step 959 determining that F6 is greater than or equal to the Threshold Fan-on Time (TFT) or the override duration. If step 955 is No (N), then step 957 energizes the fan relay (or thermostat fan G signal) and turns on the HVAC fan, and transitions to step 959. At Step 959, the fan controller determines if the fan-on operating time or the fan-on duration F6 has met or exceeded the Threshold Fan-on Time (TFT) or the override duration. The TFT or the override duration may be set to 60 minutes or greater to provide about 8 to 10 air changes per hour depending on occupant discretion (typical air filters are 25% effective at removing airborne particles). The TFT or override duration may also be set to a fraction of a fan-on setting duration including a continuous hourly fan-on setting greater than 0 minutes to 60 minutes, a continuous daily fan-on setting of 1 hour to 24 hours, and a continuous fan-on setting greater than 24 hours. The step 959 determines if the fan-on operating time or the fan-on duration F6 is greater than the TFT or if F6 is greater than the override duration.

If step 959 determines F6 is greater than or equal to the TFT or F6 is greater than or equal to the override duration for the fan-on setting, then the FDD method proceeds to Step 967 and the Fan off flag is set to indicate F6 has met or exceeded the TFT or the override duration. If step 959, is No (N), then the method continues to step 960. At step 960 if there is a thermostat call for cooling, then the method proceeds to step 962 Go to cooling fan control the step 701 (FIG. 11) to turn on the HVAC fan during a thermostat call for cooling. If there is no thermostat call for cooling, then the method proceeds to step 961. At Step 961, the FDD method determines if there is a thermostat call for heating. If step 961 is Yes (Y), then the FDD method proceeds to step 968 Go to the heating fan control step 601 (FIG. 10), to turn on the HVAC fan during a thermostat call for heating. If there is no thermostat call for heating or cooling, the method continues to Step 963 and determines if the fan signal is active. If step 963 determines Yes (Y) the fan signal is active, then the method loops back to Step 953. If step 963 determines No (N), the fan signal is not active, then the method proceeds to step 969 Go to start the FDD method step 501 (FIG. 9).

If occupied or unoccupied continuous fan-on operation is turned off prior to reaching the TFT at step 955, then the FDD method performs at least one action selected from the group consisting of: de-energizing the fan relay (or thermostat fan G signal) to turn off the HVAC fan at step 965, and monitoring the HVAC system parameters during the off cycle to continually check for faults. Adjusting the TFT allows the FDD method to determine whether or not the thermostat fan-on setting was selected by occupants to circulate air and improve air quality.

If the heating signal or the cooling signal are detected or the thermostat call for heating or the thermostat call for cooling are detected during what was previously the occupied or unoccupied continuous fan-only operation and prior to reaching the TFT, then the FDD method performs at least one action selected from the group consisting of: energizing the fan relay (or thermostat fan G signal) to continue energizing the HVAC fan, and monitoring the HVAC system parameters, waiting for the completion of either the heating cycle duration P3 or cooling cycle duration P4 while continuing to energize the HVAC fan, and upon completion of either the heating cycle duration P3 or the cooling cycle duration P4, performing at least one action selected from the group consisting of: determining a variable fan-off time delay P2 based on the heating cycle duration P3 (including the heating on cycle and/or the heating off cycle) or the cooling cycle duration P4 (including the cooling on cycle and/or the cooling off cycle), energizing or continuing to energize the fan relay and the HVAC fan for the variable fan-off delay P2, waiting for the completion of the variable fan-off time delay P2, and de-energizing the fan relay (or thermostat fan G signal) and turning off the HVAC fan at the end of the variable fan-off delay P2.

The FDD method for controlling the HVAC fan is based on comparing a current measurement of a HVAC parameter to a previous measurement of a HVAC parameter, and if a fault is detected, then performing at least one action selected from the group consisting of: turning off a fan-on setting, reporting a FDD alarm fan-on, overriding a fan-on setting, and determining a variable fan-off delay P2. Calculating the variable fan-off delay duration may be based on at least one HVAC parameter selected from the group consisting of: the variable fan-off delay P2, an off cycle time P11, a thermostat call for heating duration, a heating cycle duration P3 including at least one heating cycle selected from the group consisting of: a heating on cycle time, and a heating off cycle, a cooling cycle duration P4 including at least one cooling cycle selected from the group consisting of: a thermostat call for cooling duration, a cooling on cycle time, and a cooling off cycle. Operating the fan for the variable fan-off delay after a cooling cycle or operating the fan for the variable fan-off delay after a heating cycle and ending the variable fan-off delay may also be based on at least one method selected from the group consisting of: comparing a current measurement of a Conditioned Space Temperature (CST) to a previous measurement of the CST during the variable fan-off delay, the measurement of the CST crosses a heating fan-off delay differential offset, the measurement of the CST crosses an upper heating differential at least once after the heating cycle, the measurement of the CST crosses a cooling fan-off delay differential offset, the measurement of the CST crosses a lower cooling differential at least once after the cooling cycle, and the measurement of the CST reaches an inflection point where the rate of change of the measurement of the CST with respect to time equals zero plus or minus a confidence interval tolerance. The rate of change of the measurement of the CST is defined as a difference in temperature between at least two measurements of the CST divided by a difference in time between the at least two measurements of the CST.

A current HVAC parameter is compared to a previously monitored HVAC parameter to determine whether or not the current HVAC parameter is outside a tolerance threshold value sufficient to indicate that a fault has been detected and this fault is impacting energy efficiency performance by more than 5%. If the fault is detected and determined to impact energy efficiency performance by more than 5%, then the FDD output is used as a basis to initiate at least one action. The actions preferably include detecting, reporting and overriding a fan-on setting to save energy, and turning off a fan. A continuous fan-on setting increases fan energy use or heating or cooling energy use by accidentally or intentionally being left on for a long period of time. The actions may also comprise providing or adjusting the variable fan-off delay P2. These actions are preferably based on HVAC parameters including, for example: detecting a HVAC fan is controlled by a fan-on setting and the fan is operating for a continuous fan-on duration with or without a thermostat call for heating or cooling. Providing a variable fan-off delay at the end of a heating cycle to improve energy efficiency or providing a variable fan-off delay at the end of a cooling cycle to improve energy efficiency may be based on HVAC parameters comprising a heating cycle duration; a cooling cycle duration; a conditioned space temperature; or a rate of change of the HVAC parameters with respect to time.

The FDD method is based on at least one of the following HVAC parameters: the variable fan-off delay P2, a heating cycle duration P3 including the heating on cycle time only or the heating on cycle time and off cycle time, a heating off cycle time P11, a cooling cycle duration P4 including the cooling on cycle time only or the cooling on cycle time and the cooling off cycle time, a cooling off cycle time P11, a indoor air temperature, an outdoor air temperature (OAT), a conditioned space temperature (CST), a rate of change of CST with respect to time, an air temperature measurement, a return air temperature (RAT), a supply air temperature (SAT), a temperature rise (TR) across a heat exchanger defined as the supply air temperature minus the return air temperature, a temperature split (TS) across an evaporator defined as the return air temperature minus the supply air temperature, a thermostat temperature, a rate of change of thermostat temperature with respect to time (dT/dt), a compressor electrical power (W), a fan electrical power (W), a sound level (Decibel dB), a vibration (Hz), an airflow (cfm), an air velocity (f/s), a refrigerant pressure (psig), and a refrigerant system temperature (degrees Fahrenheit F).

In one embodiment during cooling, if the AC compressor off time P11 minus the variable fan-off delay time P2 from the previous cooling cycle, is less than a minimum time period, then an FDD algorithm based on the cooling off cycle time P11 will reduce the fan-off delay P2. In another embodiment during cooling, the AC compressor off time P11 is the target value to maximize, and the variable fan-off delay P2 is the process variable. The error is the difference between the P11 and P4 divided by P2 and defined as $e(t)=(P11-P4)/P2$ where the goal is to achieve an error between zero and 1 (i.e., off cycle time equal to or greater than cooling on cycle time, and the difference between the off cycle time and the cooling on cycle time is less than P2). The FDD method uses a Proportional Integral Differential (PID) control equation to reduce the error by adjusting the value of P2 based on the cooling cycle duration including at least one cooling cycle selected from the group consisting of: the cooling on cycle, and the cooling off cycle.

In another embodiment during heating, if the furnace off time P11 minus the fan-off delay time P2 from the previous heating cycle is less than 0.5 minutes, then an FDD algorithm based on the cooling off cycle time P11 will reduce the fan-off delay P2. In another embodiment during heating off time P11 is the target value to maximize, and the variable fan-off delay P2 is the process variable. The error is the difference between the P11 and the heating cycle duration P3 divided by P2 and defined as $e(t)=(P11-P3)/P2$ where the goal is to achieve an error between zero and 1 (i.e., off cycle time equal to or greater than heating on a temperature split across an evaporator (return air minus supply air temperature), a temperature rise across a heat exchanger (supply air minus return air temperature), outdoor air temperature, cycle time, and the difference between the off cycle time and the heating on cycle time is less than P2). The FDD method uses a Proportional Integral Differential (PID) control equation to reduce the error by adjusting the value of P2 based on the heating cycle duration including at least one heating cycle selected from the group consisting of: the heating on cycle, and the heating off cycle.

The FDD algorithm may be used to detect whether or not occupied or unoccupied fan-on operation is greater than a time limit (e.g., 0 minutes to 60 minutes or 1 hour to 24 hours, or a longer period of time depending on indoor air quality and health issues for example 7 to 10 days, etc.) then the detection method will turn off the fan using at least two methods: 1) if time limit has expired during an inactive heating cycle or an cooling cycle, then turn the fan to off; and 2) if time limit has expired, during an active heating cycle or an inactive cooling cycle, then turn the fan to off after a current heating cycle or a fan-off delay or after a current cooling cycle or the fan-off delay P2.

In another embodiment, an FDD algorithm may be used to measure the return air temperature and the supply air temperature to determine the Temperature Split (TS) (return minus supply) for cooling or the Temperature Rise (TR) (supply minus return) for heating. The FDD method can use these HVAC parameters to evaluate the current sensible cooling capacity or current heating capacity compared to threshold values and determine when to turn the fan to off during the variable fan-off delay P2 whether or not to provide an FDD error message regarding low cooling or heating capacity.

In another embodiment, an FDD algorithm can be used in a thermostat to measure the CST or the rate of change of the CST with respect to time (dT/dt). For cooling, if the current cooling CST minus the average CST during the variable fan-off delay period, is greater than the FDD threshold of 0.1 to 0.2° F., then the method will turn the low voltage G signal to the fan relay to off to turn the fan off. For heating, if the current heating CST minus the average CST during the variable fan-off delay period, is less than the FDD threshold of 0.1 to 0.2° F., then the method will turn the low voltage G signal to off to the fan relay to turn the fan off.

In another embodiment, an FDD algorithm may be used in a thermostat to calculate the rate of change of the CST with respect to time (dT/dt), and when the dT/dt reaches an Inflection Point (IP) of zero plus or minus a confidence interval tolerance, then the method will turn the low voltage G signal to the fan relay off to turn the fan off. For example, if during cooling fan-only operation dT/dt>zero plus an $FDD_{tolerance}$ then turn the fan off during the cooling fan-only period. If during heating fan-only operation dT/dt<zero minus an $FDD_{tolerance}$ then turn the fan off during the heating fan-only period.

As described herein, other embodiments may use sound, vibration, temperature, airflow (velocity), or refrigerant temperature or pressure or power measurement sensors to detect AC compressor operation during the fan-off delay or within a specific time (i.e., 0.5 minutes) after the end of the fan-off delay to set an FDD and adjust the fan-off delay for the next cooling or heating cycle to improve efficiency and thermal comfort.

While the method herein disclosed has been described by means of specific embodiments and applications thereof, numerous modifications and variations could be made thereto by those skilled in the art without departing from the scope of the method set forth in the claims.

We claim:

1. A method for controlling a Heating Ventilating Air Conditioning (HVAC) system fan with a thermostat, the method comprising:

at least one of:

cooling a conditioned space with an Air Conditioning (AC) compressor and the HVAC system fan until a drybulb temperature measurement of a Conditioned Space Temperature (CST) reaches a lower cooling differential used to end a thermostat call for cooling and providing a variable fan-off delay after the thermostat call for cooling has been satisfied to decrease the CST below the lower cooling differential, and heating the conditioned space with a heater and the HVAC system fan until the CST reaches an upper heating differential used to end a heating on cycle and providing the variable fan-off delay after a heating on cycle to increase the CST above the upper heating differential; and wherein the variable fan-off delay is ended based on comparing the CST to a CST variable fan-off delay threshold.

2. The method of claim 1, wherein the CST variable fan-off delay threshold is a cooling fan-off delay differential offset from the lower cooling differential.

3. The method of claim 1, wherein the CST variable fan-off delay threshold is a heating fan-off delay differential offset from the upper heating differential.

4. The method of claim 1, wherein the CST variable fan-off delay threshold is a lower cooling differential, and the variable fan-off delay is ended when the drybulb temperature measurement of the CST during the variable fan-off delay crosses the lower cooling differential at least once after the thermostat call for cooling has been satisfied.

5. The method of claim 1, wherein the CST variable fan-off delay threshold is an upper heating differential, and the variable fan-off delay is ended when the drybulb temperature measurement of the CST during the variable fan-off delay crosses the upper heating differential at least once after the end of the heating on cycle.

6. The method of claim 1, further including at least one of:

the lower cooling differential used to turn off the AC compressor is less than or equal to a cooling setpoint; and the upper heating differential used to turn off the heater is greater than or equal to a heating setpoint.

7. The method of claim 1, wherein:

the lower cooling differential used to turn off the AC compressor is a lower variable cooling differential used to increase or decrease the duration of the thermostat call for cooling; and the upper heating differential used to turn off the heater is an upper variable heating differential used to increase or decrease the heating on cycle.

8. A method for controlling a Heating Ventilating Air Conditioning (HVAC) system fan with a thermostat, the method comprising:

providing a variable fan-off delay after a cooling on cycle has ended or providing a variable fan-off delay after a heating on cycle has ended;

wherein the variable fan-off delay is ended based on comparing a drybulb temperature measurement of a Conditioned Space Temperature (CST) to a CST variable fan-off delay threshold;

wherein the CST variable fan-off delay threshold is based on a previous CST measurement monitored during the current variable fan-off delay; and wherein the variable fan-off delay for cooling is ended when the CST increases above the previous CST measurement or the variable fan-off delay for heating is ended when the CST decreases below the previous CST measurement.

9. A method for controlling a Heating Ventilating Air Conditioning (HVAC) system fan with a thermostat, the method comprising:

providing a variable fan-off delay after a cooling on cycle has ended or providing a variable fan-off delay after a heating on cycle has ended;

wherein the variable fan-off delay is ended based on comparing a drybulb temperature measurement of a Conditioned Space Temperature (CST) to a CST variable fan-off delay threshold; and wherein the CST variable fan-off delay threshold is an inflection point where the rate of change of the CST with respect to time (dT/dt) equals zero plus or minus a tolerance wherein the rate of change of the CST with respect to time is defined as a difference in temperature between at least two measurements of the CST divided by a difference in time between the at least two measurements of the CST.

10. A method for controlling a Heating Ventilating Air Conditioning (HVAC) system fan with a thermostat, the method comprising:

providing a variable fan-off delay after a cooling on cycle has ended or providing a variable fan-off delay after a heating on cycle has ended;

wherein the variable fan-off delay is ended based on comparing a drybulb temperature measurement of a Conditioned Space Temperature (CST) to a variable fan-off delay CST threshold;

wherein the variable fan-off delay duration is adjusted based on a duration of a cooling off cycle; and wherein the variable fan-off delay duration is increased when the cooling off cycle duration is greater than a cooling on cycle duration or the variable fan-off delay duration is decreased when the cooling off cycle duration is less than the cooling on cycle duration.

11. A method for controlling a Heating Ventilating Air Conditioning (HVAC) system fan with a thermostat, the method comprising:

providing a variable fan-off delay after a cooling on cycle has ended or providing a variable fan-off delay after a heating on cycle has ended;

wherein the variable fan-off delay is ended based on comparing a drybulb temperature measurement of a Conditioned Space Temperature (CST) to a variable fan-off delay CST threshold; and wherein the variable fan-off delay duration is decreased when the cooling off cycle duration is less than the cooling on cycle duration minus a tolerance based on a first coefficient times the cooling on cycle duration wherein the first coefficient varies as a function of the cooling on cycle duration.

12. A method for controlling a Heating Ventilating Air Conditioning (HVAC) system fan with a thermostat, the method comprising:

providing a variable fan-off delay after a cooling on cycle has ended or providing a variable fan-off delay after a heating on cycle has ended;

wherein the variable fan-off delay is ended based on comparing a drybulb temperature measurement of a Conditioned Space Temperature (CST) to a CST variable fan-off delay threshold;

wherein the variable fan-off delay duration is increased when the cooling off cycle duration is greater than the cooling on cycle duration plus a tolerance based on a second coefficient times the cooling on cycle duration wherein the second coefficient varies as a function of the cooling on cycle duration.

13. A method for controlling a Heating Ventilating Air Conditioning (HVAC) system fan with a thermostat, the method comprising:

providing a variable fan-off delay after a cooling on cycle has ended or providing a variable fan-off delay after a heating on cycle has ended;

wherein the variable fan-off delay is ended based on comparing a drybulb temperature measurement of a Conditioned Space Temperature (CST) to a CST variable fan-off delay threshold;

wherein the variable fan-off delay duration is adjusted based on a duration of a heating off cycle; and wherein the variable fan-off delay duration is increased when the heating off cycle duration is greater than a heating on cycle duration or the variable fan-off delay duration is decreased when the heating off cycle duration is less than the heating on cycle duration.

14. A method for controlling a Heating Ventilating Air Conditioning (HVAC) system fan with a thermostat, the method comprising:

providing a variable fan-off delay after a cooling on cycle has ended or providing a variable fan-off delay after a heating on cycle has ended;

wherein the variable fan-off delay is ended based on comparing a drybulb temperature measurement of a Conditioned Space Temperature (CST) to a CST variable fan-off delay threshold; and wherein the variable fan-off delay duration after the heating on cycle is decreased when the heating off cycle duration is less than the heating on cycle duration minus a tolerance based on a third coefficient times the heating on cycle duration wherein the third coefficient varies as a function of the heating on cycle duration.

15. A method for controlling a Heating Ventilating Air Conditioning (HVAC) system fan with a thermostat, the method comprising:

providing a variable fan-off delay after a cooling on cycle or providing a variable fan-off delay after a heating on cycle;

wherein the variable fan-off delay is ended based on comparing a drybulb temperature measurement of a Conditioned Space Temperature (CST) to a CST variable fan-off delay threshold; and wherein the variable fan-off delay duration after the heating on cycle is increased when the previous heating off cycle duration is greater than the current heating on cycle duration plus a tolerance based on a fourth coefficient times the heating on cycle duration wherein the fourth coefficient varies as a function of the heating on cycle duration.

* * * * *